US009773448B2

(12) United States Patent
Yata et al.

(10) Patent No.: US 9,773,448 B2
(45) Date of Patent: Sep. 26, 2017

(54) DISPLAY DEVICE, ELECTRONIC APPARATUS, AND METHOD FOR DISPLAYING IMAGE

(71) Applicant: Japan Display Inc., Tokyo (JP)

(72) Inventors: Tatsuya Yata, Tokyo (JP); Takayuki Nakanishi, Tokyo (JP)

(73) Assignee: Japan Display Inc., Tokyo (JP)

( * ) Notice: Subject to any disclaimer, the term of this patent is extended or adjusted under 35 U.S.C. 154(b) by 126 days.

(21) Appl. No.: 14/755,575

(22) Filed: Jun. 30, 2015

(65) Prior Publication Data

US 2016/0005381 A1 Jan. 7, 2016

(30) Foreign Application Priority Data

Jul. 1, 2014 (JP) ..... 2014-135878

(51) Int. Cl.

| | |
|---|---|
| ***G09G 3/32*** | (2016.01) |
| ***G09G 3/3208*** | (2016.01) |
| ***G09G 3/20*** | (2006.01) |
| ***G09G 3/3225*** | (2016.01) |
| ***G09G 3/3233*** | (2016.01) |

(52) U.S. Cl.

CPC ..... *G09G 3/3208* (2013.01); *G09G 3/2074* (2013.01); *G09G 3/3225* (2013.01); *G09G 3/3233* (2013.01); *G09G 2300/0452* (2013.01); *G09G 2320/0242* (2013.01); *G09G 2340/06* (2013.01)

(58) Field of Classification Search

CPC ..... G06F 3/0414; G06F 3/041; G06F 3/0416; G06F 3/044; G06F 2203/04105; G06F 2203/04106

See application file for complete search history.

(56) References Cited

U.S. PATENT DOCUMENTS

| | | | | |
|---|---|---|---|---|
| 2004/0178973 A1* | 9/2004 | Miller | ..... | G09G 3/3208 345/82 |
| 2005/0099426 A1 | 5/2005 | Primerano et al. | | |
| 2012/0236016 A1* | 9/2012 | Fujino | ..... | G09G 3/3241 345/589 |

FOREIGN PATENT DOCUMENTS

| | | |
|---|---|---|
| JP | 2007-514184 | 5/2007 |
| JP | 2012-194256 | 10/2012 |
| WO | 2005-048232 | 5/2005 |

* cited by examiner

*Primary Examiner* — Sahlu Okebato

(74) *Attorney, Agent, or Firm* — K&L Gates LLP

(57) ABSTRACT

According to an aspect, a display device includes: an image display unit provided with a plurality of pixels each including a first sub-pixel for displaying a first color component, a second sub-pixel for displaying a second color component, a third sub-pixel for displaying a third color component, and a fourth sub-pixel that has higher luminance or higher power efficiency for display than that of the first sub-pixel, the second sub-pixel, and the third sub-pixel, and displays an additional color component different from the first sub-pixel, the second sub-pixel, and the third sub-pixel; a replacement ratio calculation unit that calculates a replacement ratio, generates an output signal based on the replacement ratio, and outputs the generated output signal to a drive circuit.

15 Claims, 16 Drawing Sheets

DISPLAY DEVICE, ELECTRONIC APPARATUS, AND METHOD FOR DISPLAYING IMAGE

CROSS REFERENCES TO RELATED APPLICATIONS

The present application claims priority to Japanese Priority Patent Application JP 2014-135878 filed in the Japan Patent Office on Jul. 1, 2014, the entire content of which is hereby incorporated by reference.

BACKGROUND

1. Technical Field

The present disclosure relates to a display device, an electronic apparatus, and a method for displaying an image.

2. Description of the Related Art

In the related art, liquid crystal display devices have been employed including an RGBW-type liquid crystal panel in which a pixel W (white) is added to pixels R (red), G (green), and B (blue). This RGBW-type liquid crystal display device can reduce luminance of a backlight by distributing, to the pixel W, a transmission amount of light from the backlight at the pixels R, G, and B based on RGB data that determines image display to display an image, thereby reducing power consumption.

In addition to the liquid crystal display devices, known is image display panels such as an organic light emitting diode (OLED) that light a self-luminous body. For example, Published Japanese Translation of PCT Application No. 2007-514184 discloses a method for converting an input signal of three colors (R, G, B) corresponding to three color gamut defining primary colors into an output signal of four colors (R', G', B', W) corresponding to the color gamut defining primary colors and an additional primary color W to drive a display device including a light emitting body that emits light corresponding to the output signal of four colors.

A display device including an image display panel that lights a self-luminous body requires no backlight, and an amount of electric power of the display device is determined depending on a lighting quantity of the self-luminous body in each pixel. The display device determines a ratio of replacing pixels with a pixel W, that is, a replacement ratio based on characteristics of the self-luminous body. Accordingly, a small replacement ratio decreases reduction in power consumption. However, when the replacement ratio is set to be high, an error occurs between a color to be displayed and a color that is actually displayed.

The display device, the electronic apparatus, and the method for displaying an image according to the present disclosure increase a lighting quantity of the fourth sub-pixel while reducing the error in the color to be displayed, so that the power consumption can be suppressed.

SUMMARY

According to an aspect, a display device includes an image display unit provided with a plurality of pixels each including: a first sub-pixel for displaying a first color component according to a lighting quantity of a self-luminous body provided to the first sub-pixel; a second sub-pixel for displaying a second color component according to a lighting quantity of a self-luminous body provided to the second sub-pixel; a third sub-pixel for displaying a third color component according to a lighting quantity of a self-luminous body provided to the third sub-pixel; and a fourth sub-pixel that has higher luminance or higher power efficiency for display than that of the first sub-pixel, the second sub-pixel, and the third sub-pixel, and displays an additional color component different from the first sub-pixel, the second sub-pixel, and the third sub-pixel according to a lighting quantity of a self-luminous body provided to the fourth sub-pixel; a replacement ratio calculation unit that calculates a replacement ratio with the additional color component; and a fourth sub-pixel signal processing unit that receives, as an input signal, input color information to be displayed on a certain pixel obtained based on an input video signal, generates an output signal including an output color information obtained by converting the input color information into the first component, the second component, the third component, and the additional color component based on the replacement ratio, and outputs the generated output signal to a drive circuit that controls driving of the image display unit.

According to an aspect, a method is for displaying an image of an input signal supplied to a drive circuit in an image display unit provided with a plurality of pixels each including: a first sub-pixel for displaying a first color component according to a lighting quantity of a self-luminous body provided to the first sub-pixel; a second sub-pixel for displaying a second color component according to a lighting quantity of a self-luminous body provided to the second sub-pixel; a third sub-pixel for displaying a third color component according to a lighting quantity of a self-luminous body provided to the third sub-pixel; and a fourth sub-pixel that has higher luminance or higher power efficiency for display than that of the first sub-pixel, the second sub-pixel, and the third sub-pixel, and displays an additional color component different from the first sub-pixel, the second sub-pixel, and the third sub-pixel according to a lighting quantity of a self-luminous body provided to the fourth sub-pixel. The method includes: calculating a replacement ratio with the additional color component; and a fourth sub-pixel signal processing for receiving, as a first input signal, input color information to be displayed on a certain pixel obtained based on an input video signal; generating an output signal including an output color information obtained by converting the input color information into the first color component, the second color component, the third color component, and the additional color component based on the replacement ratio; and outputting the generated output signal to the drive circuit that controls driving of the image display unit.

Additional features and advantages are described herein, and will be apparent from the following Detailed Description and the figures.

DETAILED DESCRIPTION

Figure 1:
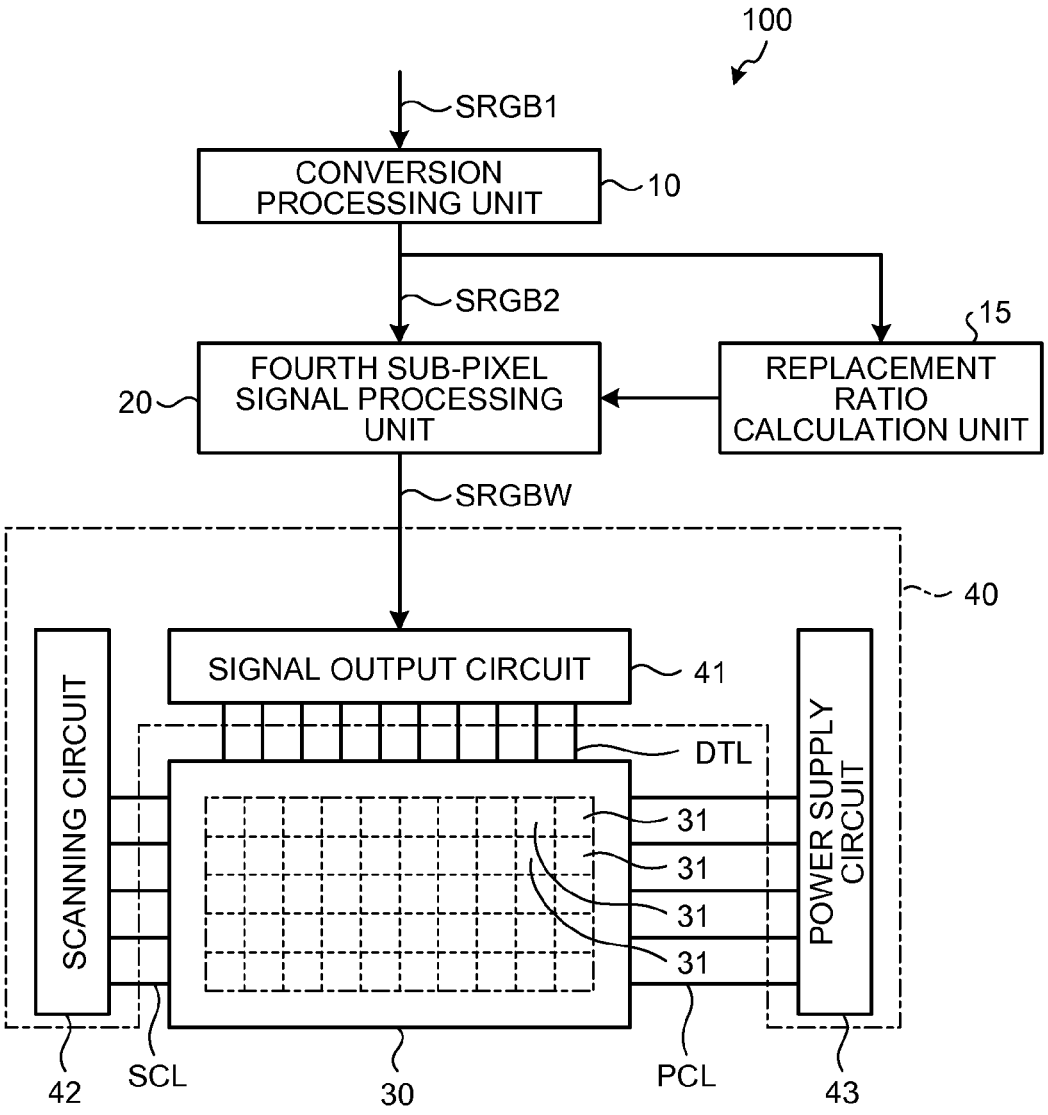
FIG. 1 is a block diagram illustrating an example of a configuration of a display device according to an embodiment.

The following describes a preferred embodiment in detail with reference to the drawings. The present invention is not limited to the embodiment described below. Components described below include a component that is easily conceivable by those skilled in the art and substantially the same component. The components described below can be appropriately combined. The disclosure is merely an example, and the present invention naturally encompasses an appropriate modification maintaining the gist of the invention that is easily conceivable by those skilled in the art. To further clarify the description, a width, a thickness, a shape, and the like of each component may be schematically illustrated in the drawings as compared with an actual aspect. However, this is merely an example and interpretation of the invention is not limited thereto. The same element as that described in the drawing that has already been discussed is denoted by the same reference numeral through the description and the drawings, and detailed description thereof will not be repeated in some cases.

Configuration of Display Device

Figure 2:
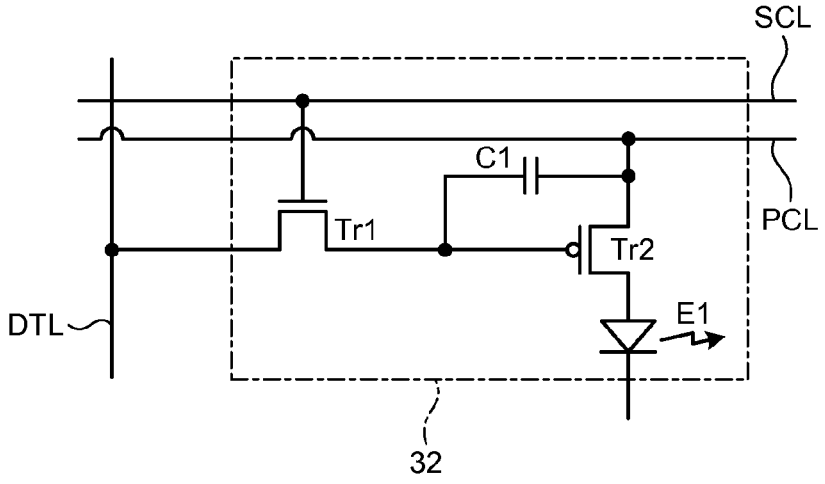
FIG. 2 is a diagram illustrating a lighting drive circuit of a sub-pixel included in a pixel of an image display unit according to the embodiment.
Figure 3:
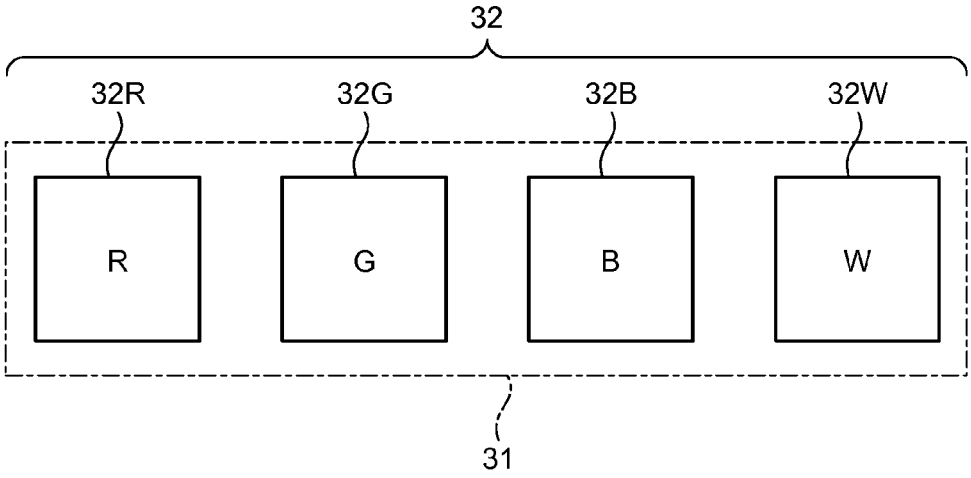
FIG. 3 is a diagram illustrating an array of sub-pixels in the image display unit according to the embodiment.
Figure 4:
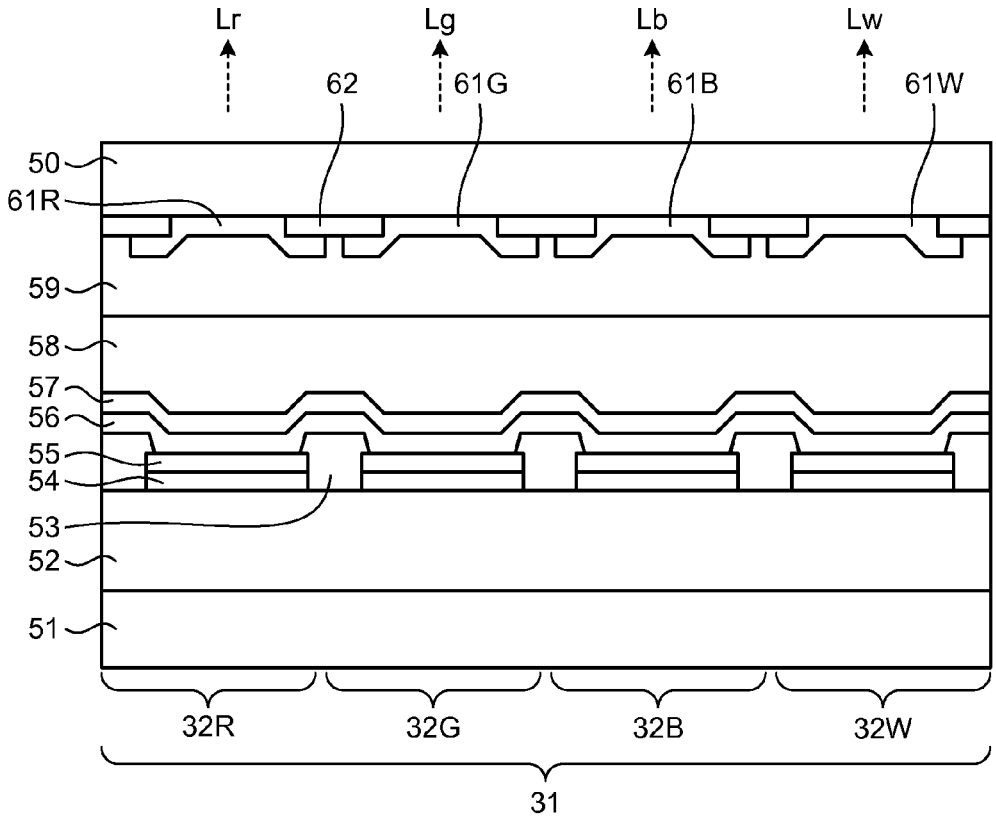
FIG. 4 is a diagram illustrating a sectional structure of the image display unit according to the embodiment.
Figure 5:
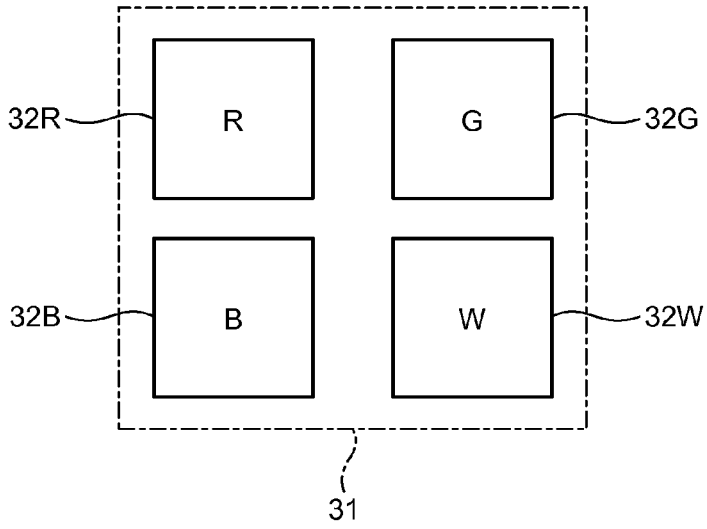
FIG. 5 is a diagram illustrating an array of the sub-pixels in the image display unit according to the embodiment.

FIG. 1 is a block diagram illustrating an example of a configuration of a display device according to the embodiment. FIG. 2 is a diagram illustrating a lighting drive circuit of a sub-pixel included in a pixel of an image display unit according to the embodiment. FIG. 3 is a diagram illustrating an array of sub-pixels in the image display unit according to the embodiment. FIG. 4 is a diagram illustrating a sectional structure of the image display unit according to the embodiment. FIG. 5 is a diagram illustrating an array of the sub-pixels in the image display unit according to the embodiment.

As illustrated in FIG. 1, a display device 100 includes a conversion processing unit 10, a replacement ratio calculation unit 15, a fourth sub-pixel signal processing unit 20, an image display unit 30 serving as an image display panel, and an image-display-panel drive circuit 40 (hereinafter, also referred to as a drive circuit 40) that controls driving of the image display unit 30. Functions of the conversion processing unit 10 and the fourth sub-pixel signal processing unit 20 may be implemented as hardware or software, and are not specifically limited. Even when each circuit of the conversion processing unit 10 and the fourth sub-pixel signal processing unit 20 is configured as hardware, it is not necessary to provide each circuit physically separately. A plurality of functions may be implemented with a physically single circuit.

The conversion processing unit 10 receives, as a first input signal (input color information) SRGB1, input first color information (input color information) to be displayed on a certain pixel obtained based on an input video signal. The conversion processing unit 10 outputs a second input signal (converted input color signal) SRGB2 obtained by converting the first color information as an input value of an HSV (Hue-Saturation-Value, Value is also called Brightness) color space into a second color information (converted input color information). Each of the first color information and the second color information is an input signal of three colors (R, G, B) including a red (R) component, a green (G) component, and a blue (B) component. The conversion processing unit 10 performs correction (color space correction) for adjusting the red (R) component, the green (G) component, and the blue (B) component of the first color information, and γ correction. Various correction processes can be performed as the color space correction.

When the input value (second input signal SRGB2) of an input HSV color space of the input signal is converted into an extended value (third input signal SRGBW) of an extended HSV color space extended with a first color, a second color, a third color, and a fourth color, the replacement ratio calculation unit 15 calculates a replacement ratio with the fourth color. Specifically, the replacement ratio calculation unit 15 calculates a ratio of values to be replaced with the fourth color among values that can be replaced with the fourth color calculated based on the second input signal SRGB2. The fourth color is assumed to be W in this embodiment, so that the replacement ratio is a W replacement ratio. Calculation of the replacement ratio will be described later.

The fourth sub-pixel signal processing unit 20 is coupled to the image-display-panel drive circuit 40 for driving the image display unit 30. For example, the fourth sub-pixel signal processing unit 20 converts the input value (second input signal SRGB2) of the input HSV color space of the input signal into the extended value (third input signal SRGBW) of the extended HSV color space extended with the first color, the second color, the third color, and the fourth color to generate the third input signal SRGBW, and outputs the generated third input signal SRGBE serving as an output signal output signal to the image display unit 30. The fourth sub-pixel signal processing unit 20 then generates the third input signal SRGBW based on the second input signal SRGB2 and the replacement ratio calculated by the replacement ratio calculation unit 15. In this way, the fourth sub-pixel signal processing unit 20 outputs, to the drive circuit 40, the third input signal SRGBW including third color information obtained by converting red (R), green (G), and blue (B) components of the second color information of the second input signal SRGB2 into the red (R) component, the green (G) component, the blue (B) component, and the white (W) component serving as an additional color component. The third color information is an input signal of four colors (R, G, B, W). As the additional color component, exemplified is a white component in which gradation value of each of the red (R) component, the green (G) component, and the blue (B) component is configured as (R, G, B)=(255, 255, 255) in 256 gradations. However, the embodiment is not limited thereto. For example, the additional color component may be converted as the fourth sub-pixel having a color component represented as (R, G, B)=(255, 230, 204).

In the embodiment, as described above, processing of converting the input signal (for example, RGB) into the HSV space is exemplified as conversion processing. However, the embodiment is not limited thereto. Alternatively, an XYZ space, a YUV space, and other coordinate systems may be employed. The color gamut of Adobe (registered trademark) RGB and sRGB as the color gamut of the display device are represented in a triangular range on an xy chromaticity range of an XYZ color system. However, a certain color space in which a defined color gamut is defined is not limited to be represented in the triangular range. Alternatively, the certain color space may be determined in a range of any shape such as a polygon.

The fourth sub-pixel signal processing unit 20 outputs the generated output signal to the image-display-panel drive circuit 40. The drive circuit 40 is a control device for the image display unit 30, and includes a signal output circuit 41, a scanning circuit 42, and a power supply circuit 43. The drive circuit 40 holds the third input signal SRGBW including the third color information by the signal output circuit 41, and sequentially outputs the third input signal SRGBW to each pixel 31 of the image display unit 30. The signal output circuit 41 is electrically coupled to the image display unit 30 via a signal line DTL. The drive circuit 40 selects a sub-pixel of the image display unit 30 using the scanning circuit 42, and controls ON/OFF of a switching element (for example, a thin film transistor (TFT)) for controlling an operation (light transmittance) of the sub-pixel. The scanning circuit 42 is electrically coupled to the image display unit 30 via a scanning line SCL. The power supply circuit 43 supplies electric power to a self-luminous body (described later) of each pixel 31 via a power supply line PCL.

Various modifications disclosed in Japanese Patent No. 3167026, Japanese patent No. 3805150, Japanese Patent No. 4870358, Japanese Patent Application Laid-open Publication No. 2011-90118, and Japanese Patent Application Laid-open Publication No. 2006-3475 can be applied to the display device 100.

As illustrated in FIG. 1, in the image display unit 30, $P_0 \times Q_0$ pixels 31 are two-dimensionally arranged in a matrix ($P_0$ in a row direction, and $Q_0$ in a column direction).

The pixel 31 includes a plurality of sub-pixels 32, and lighting drive circuits for the sub-pixels 32 illustrated in FIG. 2 are two-dimensionally arranged in a matrix. The lighting drive circuit includes a control transistor Tr1, a driving transistor Tr2, and a charge holding capacitor C1. A gate of the control transistor Tr1 is coupled to the scanning line SCL, a source thereof is coupled to the signal line DTL, and a drain thereof is coupled to a gate of the driving transistor Tr2. One end of the charge holding capacitor C1 is coupled to the gate of the driving transistor Tr2, and the other end thereof is coupled to a source of the driving transistor Tr2. The source of the driving transistor Tr2 is coupled to the power supply line PCL, and a drain of the driving transistor Tr2 is coupled to an anode of an organic light emitting diode E1 serving as a self-luminous body. A cathode of the organic light emitting diode E1 is coupled to a reference potential (for example, a ground). FIG. 2 illustrates an example in which the control transistor Tr1 is an n-channel transistor, and the driving transistor Tr2 is a p-channel transistor. However, polarities of the transistors are not limited thereto. The polarity of each of the control transistor Tr1 and the driving transistor Tr2 may be determined as needed.

As illustrated in FIG. 3, for example, the pixel 31 includes a first sub-pixel 32R, a second sub-pixel 32G, a third sub-pixel 32B, and a fourth sub-pixel 32W. The first sub-pixel 32R displays a first primary color (for example, a red (R) component). The second sub-pixel 32G displays a second primary color (for example, a green (G) component). The third sub-pixel 32B displays a third primary color (for example, a blue (B) component). The fourth sub-pixel 32W displays a fourth color (specifically, white) as an additional color component different from the first primary color, the second primary color, and the third primary color. Hereinafter, when it is not necessary to distinguish the first sub-pixel 32R, the second sub-pixel 32G, the third sub-pixel 32B, and the fourth sub-pixel 32W from each other, they are collectively referred to as the sub-pixel 32.

The image display unit 30 includes a substrate 51, insulating layers 52 and 53, a reflective layer 54, a lower electrode 55, a self-luminous layer 56, an upper electrode 57, an insulating layer 58, an insulating layer 59, color filters 61R, 61G, 61B, and 61W serving as color conversion layers, a black matrix 62 as a light shielding layer, and a substrate 50 (refer to FIG. 4). The color filter 61W is not necessarily provided. The substrate 51 is a semiconductor substrate made of silicon and the like, a glass substrate, or a resin substrate, and forms or holds the lighting drive circuit and the like described above. The insulating layer 52 is a protective film that protects the lighting drive circuit and the like described above, and silicon oxide, silicon nitride, and the like can be used for the insulating layer 52. The lower electrode 55 is provided to each of the first sub-pixel 32R, the second sub-pixel 32G, the third sub-pixel 32B, and the fourth sub-pixel 32W, and is an electric conductor serving as an anode (positive pole) of the organic light emitting diode E1 described above. The lower electrode 55 is a translucent electrode formed of translucent conductive material (translucent conductive oxide) such as indium tin oxide (ITO). The insulating layer 53, which is called a bank, is an insulating layer for separating the first sub-pixel 32R, the second sub-pixel 32G, the third sub-pixel 32B, and the fourth sub-pixel 32W from each other. The reflective layer 54 is made of material having metallic luster that reflects light from the self-luminous layer 56, such as silver, aluminum, and gold. The self-luminous layer 56 includes an organic material, and includes a hole injection layer, a hole transport layer, a light emitting layer, an electron transport layer, and an electron injection layer, which are not illustrated.

Hole Transport Layer

As a layer for generating a hole, for example, preferably used is a layer including an aromatic amine compound and a substance that exhibits an electron accepting property to the compound. In this case, the aromatic amine compound is a substance having an arylamine skeleton. Especially preferred is an aromatic amine compound containing triphenylamine in a skeleton and having a molecular weight of 400 or more. Among aromatic amine compound containing triphenylamine in the skeleton, especially preferred is an aromatic amine compound containing a condensed aromatic ring such as a naphthyl group in the skeleton. By using the aromatic amine compound containing triphenylamine and a condensed aromatic ring in the skeleton, heat resistance of a light-emitting element is improved. Specific examples of the aromatic amine compound include, but are not limited to, 4,4'-bis[N-(1-naphthyl)-N-phenylamino]biphenyl (abbreviated as α-NPD), 4,4'-bis[N-(3-methylphenyl)-N-phenylamino]biphenyl (abbreviated as TPD), 4,4',4"-tris(N,N-diphenylamino)triphenylamine (abbreviated as TDATA), 4,4',4"-tris[N-(3-methylphenyl)-N-phenylamino]triphenylamine (abbreviated as MTDATA), 4,4'-bis[N-{4-(N,N-di-m-tolylamino)phenyl}-N-phenylamino]biphenyl (abbreviated as DNTPD), 1,3,5-tris[N,N-di(m-tolyl)amino]benzene (abbreviated as m-MTDAB), 4,4',4"-tris(N-carbazolyl)triphenylamine (abbreviated as TCTA), 2,3-bis(4-diphenylamino phenyl)quinoxaline (abbreviated as TPAQn), 2,2',3,3'-tetrakis(4-diphenylamino phenyl)-6,6'-bisquinoxaline (abbreviated as D-TriPhAQn), and 2,3-bis{4-[N-(1-naphthyl)-N-phenylamino]phenyl}-dibenzo[f,h]quinoxaline (abbreviated as NPADiBzQn). The substance exhibiting the electron accepting property to the aromatic amine compound is not specifically limited. Examples of the substance include, but are not limited to, molybdenum oxide, vanadium oxide, 7,7,8,8-tetracyanoquinodimethane (abbreviated as TCNQ), and 2,3,5,6-tetrafluoro-7,7,8,8-tetracyanoquinodimethane (abbreviated as F4-TCNQ).

Electron Injection Layer, Electron Transport Layer

An electron transport substance is not specifically limited. Examples of the electron transport substance include, but are not limited to, a metal complex such as tris(8-quinolinolato)aluminum (abbreviated as Alq3), tris(4-methyl-8-quinolinolato)aluminum (abbreviated as Almq3), bis(10-hydroxybenzo[h]-quinolinato)beryllium (abbreviated as BeBq2), bis(2-methyl-8-quinolinolato)-4-phenylphenolate-aluminum (abbreviated as BAlq), bis[2-(2-hydroxyphenyl)benzoxazolato]zinc (abbreviated as Zn(BOX)2), and bis[2-(2-hydroxyphenyl)benzothiazolato]zinc (abbreviated as Zn(BTZ)2). Additionally, examples of the electron transport substance include, but are not limited to, 2-(4-biphenylyl)-5-(4-tert-butylphenyl)-1,3,4-oxadiazole (abbreviated as PBD), 1,3-bis[5-(p-tert-butylphenyl)-1,3,4-oxadiazole-2-yl]benzene (abbreviated as OXD-7), 3-(4-tert-butylphenyl)-4-phenyl-5-(4-biphenylyl)-1,2,4-triazole (abbreviated as TAZ), 3-(4-tert-butylphenyl)-4-(4-ethylphenyl)-5-(4-biphenylyl)-1,2,4-triazole (abbreviated as p-EtTAZ), bathophenanthroline (abbreviated as BPhen), and bathocuproin (abbreviated as BCP). A substance exhibiting an electron donating property to the electron transport substance is not specifically limited. Examples of the substance include, but are not limited to, alkali metals such as lithium and cesium, alkaline-earth metals such as magnesium and calcium, and rare earth metals such as erbium and ytterbium. The substance exhibiting the electron donating property to the electron transport substance may be a substance selected from among alkali metal oxides and alkaline-earth metal oxides such as lithium oxide (Li2O), calcium oxide (CaO), sodium oxide (Na2O), potassium oxide (K2O), and magnesium oxide (MgO).

Light Emitting Layer

For example, to obtain red-based light emission, a substance exhibiting light emission that has a peak of an emission spectrum from 600 nm to 680 nm can be used, such as 4-dicyanomethylene-2-isopropyl-6-[2-(1,1,7,7-tetramethyljulolidine-9-yl)ethenyl]-4H-pyrane (abbreviated as DCJTI), 4-dicyanomethylene-2-methyl-6-[2-(1,1,7,7-tetramethyljulolidine-9-yl)ethenyl]-4H-pyrane (abbreviated as DCJT), 4-dicyanomethylene-2-tert-butyl-6-[2-(1,1,7,7-tetramethyljulolidine-9-yl)ethenyl]-4H-pyrane (abbreviated as DCJTB), periflanthene, and 2,5-dicyano-1,4-bis[2-(10-methoxy-1,1,7,7-tetramethyljulolidine-9-yl) ethenyl]benzene. To obtain green-based light emission, a substance exhibiting light emission that has a peak of an emission spectrum from 500 nm to 550 nm can be used, such as N,N'-dimethylquinacridone (abbreviated as DMQd), coumarin 6 or coumarin 545T, and tris(8-quinolinolato)aluminum (abbreviated as Alq3). To obtain blue-based light emission, a substance exhibiting light emission that has a peak of an emission spectrum from 420 nm to 500 nm can be used, such as 9,10-bis(2-naphthyl)-tert-butylanthracene (abbreviated as t-BuDNA), 9,9'-bianthryl, 9,10-diphenyl anthracene (abbreviated as DPA), 9,10-bis(2-naphthyl)anthracene (abbreviated as DNA), bis(2-methyl-8-quinolinolato)-4-phenylphenolate-gallium (abbreviated as BGaq), and bis(2-methyl-8-quinolinolato)-4-phenylphenolate-aluminum (abbreviated as BAlq). In addition to substances emitting fluorescence as described above, a substance emitting phosphorescence can also be used as a light-emitting substance, such as bis[2-(3,5-bis(trifluoromethyl)phenyl)pyridinato-N,C2']iridium(III)picolinate (abbreviated as Ir(CF3ppy)2(pic)), bis[2-(4,6-difluorophenyl)pyridinato-N,C2']iridium(III)acetylacetonate (abbreviated as FIr(acac)), bis[2-(4,6-difluorophenyl)pyridinato-N,C2']iridium(III)picolinate (FIr(pic)), and tris(2-phenylpyridinato-N,C2')iridium (abbreviated as Ir(ppy)3).

The upper electrode 57 is a translucent electrode formed of translucent conductive material (translucent conductive oxide) such as indium tin oxide (ITO). In the embodiment, ITO is exemplified as an example of the translucent conductive material, but the embodiment is not limited thereto. As the translucent conductive material, a conductive material having different composition such as indium zinc oxide (IZO) may be used. The upper electrode 57 serves as a cathode (negative pole) of the organic light emitting diode E1. The insulating layer 58 is a sealing layer that seals the upper electrode 57, and can be made of silicon oxide, silicon nitride, and the like. The insulating layer 59 is a planarization layer that reduces level difference caused by the bank, and can be made of silicon oxide, silicon nitride, and the like. The substrate 50 is a translucent substrate that protects the entire image display unit 30, and can be a glass substrate, for example. FIG. 4 illustrates an example in which the lower electrode 55 is an anode (positive pole) and the upper electrode 57 is a cathode (negative pole), but the embodiment is not limited thereto. Alternatively, the lower electrode 55 may be a cathode and the upper electrode 57 may be an anode. In this case, the polarity of the driving transistor Tr2 electrically coupled to the lower electrode 55 can be appropriately changed, and a stacking order of a carrier injection layer (a hole injection layer and an electron injection layer), a carrier transport layer (a hole transport layer and an electron transport layer), and the light-emitting layer can be appropriately changed.

The image display unit 30 is a color display panel. As illustrated in FIG. 4, the first color filter 61R is arranged between the first sub-pixel 32R and an image observer for transmitting first primary color light Lr among light emitting components in the self-luminous layer 56. Similarly, in the image display unit 30, the second color filter 61G is arranged between the second sub-pixel 32G and the image observer for transmitting second primary color light Lg among the light emitting components in the self-luminous layer 56. Similarly, in the image display unit 30, the third color filter 61B is arranged between the third sub-pixel 32B and the image observer for transmitting third primary color light Lb among the light emitting components in the self-luminous layer 56. Similarly, the fourth color filter 61W is arranged between the fourth sub-pixel 32W and the image observer for transmitting a light emitting component adjusted to be fourth primary color light Lw among the light emitting components in the self-luminous layer 56. The image display unit 30 can emit, from the fourth sub-pixel 32W, the fourth primary color light Lw having a color component different from that of the first primary color light Lr, the second primary color light Lg, and the third primary color light Lb. No color filter may be arranged between the fourth sub-pixel 32W and the image observer. In the pixel 31, the light emitting components in the self-luminous layer 56 do not necessarily transmit through the color conversion layer such as a color filter, and the fourth sub-pixel 32W can emit the fourth primary color light Lw having the color component different from that of the first primary color light Lr, the second primary color light Lg, and the third primary color light Lb. For example, in the pixel 31, a transparent resin layer may be provided to the fourth sub-pixel 32W in place of the fourth color filter 61W for adjusting color. The pixel 31 thus provided with the transparent resin layer can suppress the occurrence of a large gap above the fourth sub-pixel 32W, otherwise a large gap occurs because no color filter is provided to the fourth sub-pixel 32W.

FIG. 5 is a diagram illustrating another array of the sub-pixels in the image display unit according to the embodiment. In the image display unit 30, the pixels 31 are arranged in a matrix. In each of the pixels 31, the sub-pixels 32 each including the first sub-pixel 32R, the second sub-pixel 32G, the third sub-pixel 32B, and the fourth sub-pixel 32W are arranged in two rows and two columns.

Figure 6:
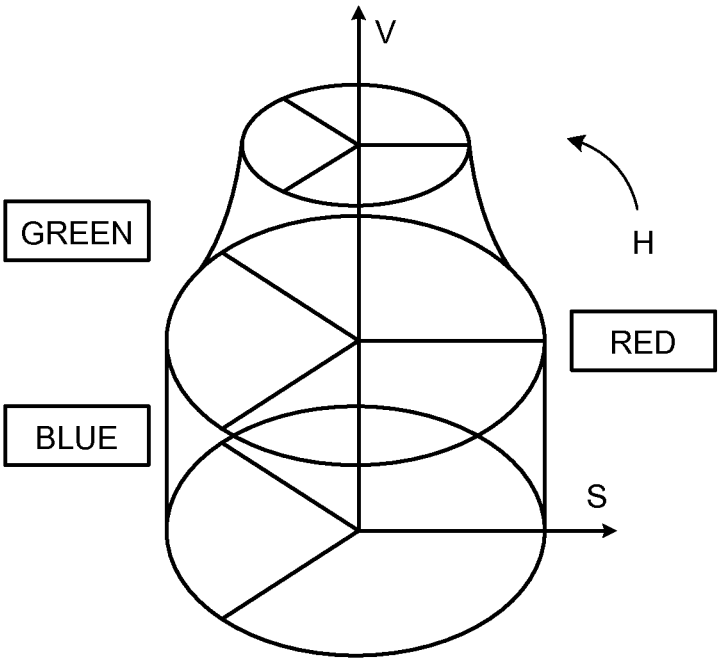
FIG. 6 is a conceptual diagram of an extended HSV color space that can be extended with the display device according to the embodiment.
Figure 7:
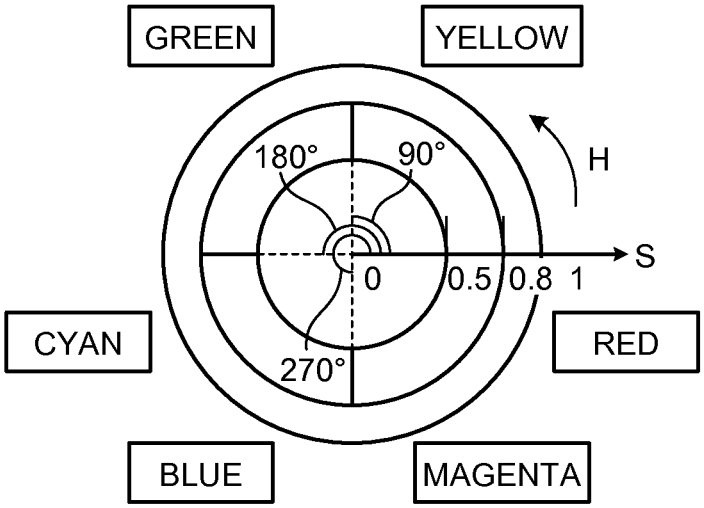
FIG. 7 is a conceptual diagram illustrating a relation between a hue and saturation in the extended HSV color space.

FIG. 6 is a conceptual diagram of the extended HSV color space that can be extended with the display device according to the embodiment. FIG. 7 is a conceptual diagram illustrating a relation between a hue and saturation in the extended HSV color space. When the pixel 31 includes the fourth sub-pixel 32W that outputs the fourth color (white), the display device 100 can widen a dynamic range of brightness in the HSV color space as illustrated in FIG. 6. That is, as illustrated in FIG. 6, a substantially truncated cone, in which the maximum value of a brightness V is reduced as saturation S increases, is placed on a cylindrical HSV color space that can be displayed by the first sub-pixel 32R, the second sub-pixel 32G, and the third sub-pixel 32B.

The first input signal SRGB1 includes input signals of respective gradation values of the red (R) component, the green (G) component, and the blue (B) component as the first color information, so that the first input signal SRGB1 is information in the cylindrical part of the HSV color space, that is, in the cylindrical part of the HSV color space illustrated in FIG. 6.

As illustrated in FIG. 7, a hue H is represented in a range from 0° to 360°. From 0° toward 360°, provided are red, yellow, green, cyan, blue, magenta, and red. In the embodiment, a region including an angle 0° represents red, a region including an angle 120° represents green, and a region including an angle 240° represents blue.

Figure 8:
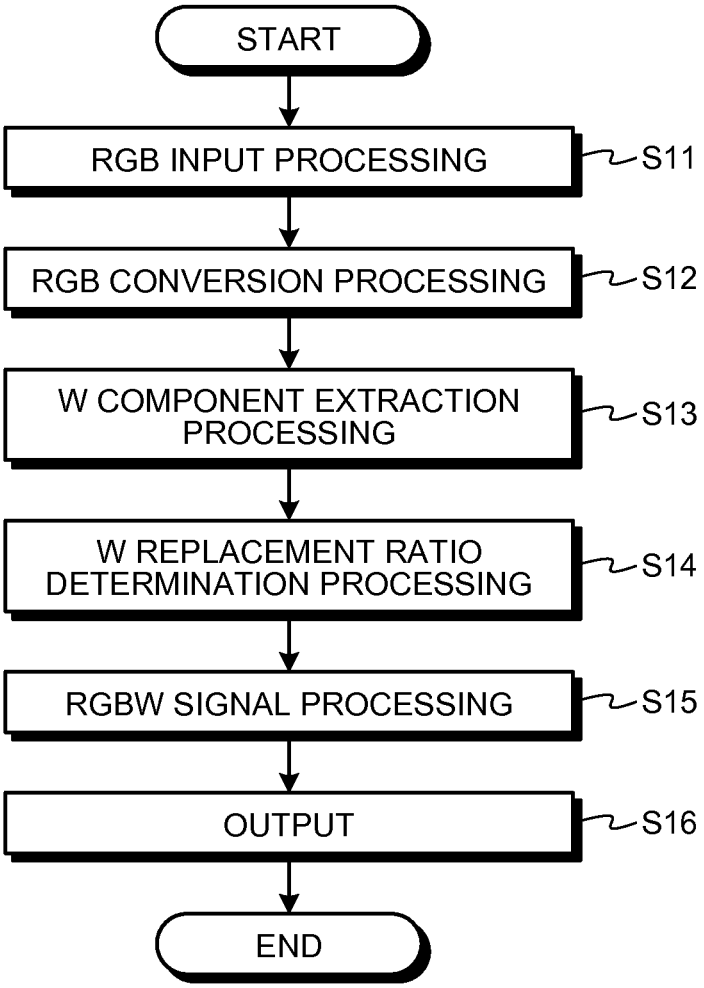
FIG. 8 is a flowchart for explaining a method for displaying an image according to the embodiment.
Figure 9:
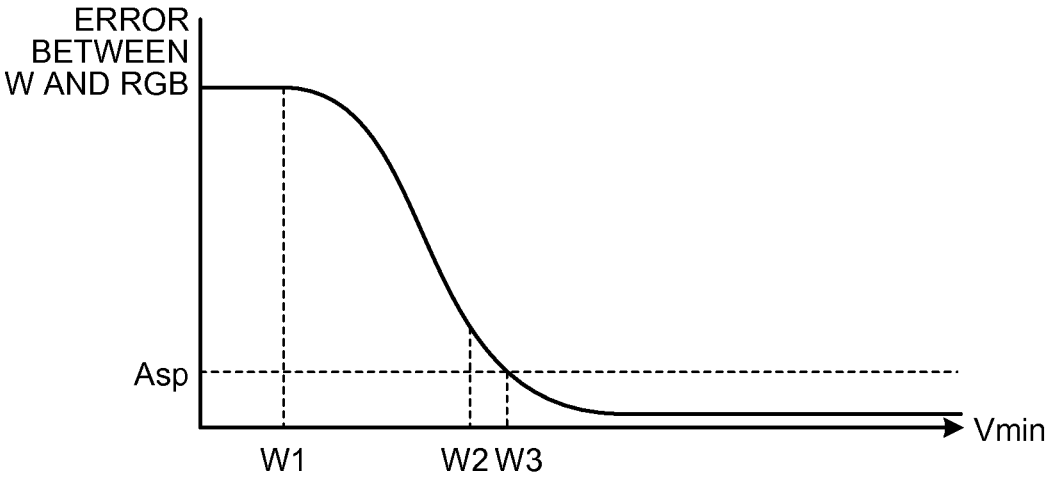
FIG. 9 is an explanatory diagram for explaining the method for displaying an image according to the embodiment.
Figure 10:
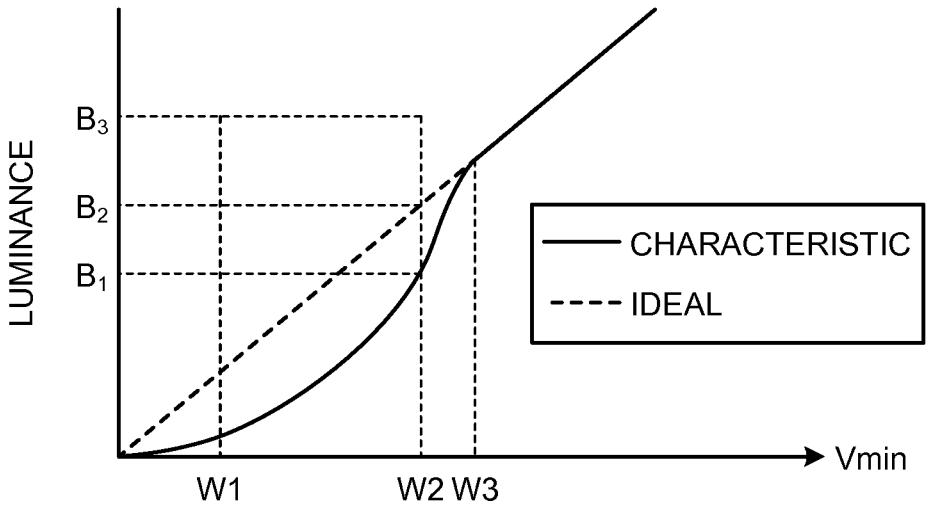
FIG. 10 is an explanatory diagram for explaining the method for displaying an image according to the embodiment.
Figure 11:
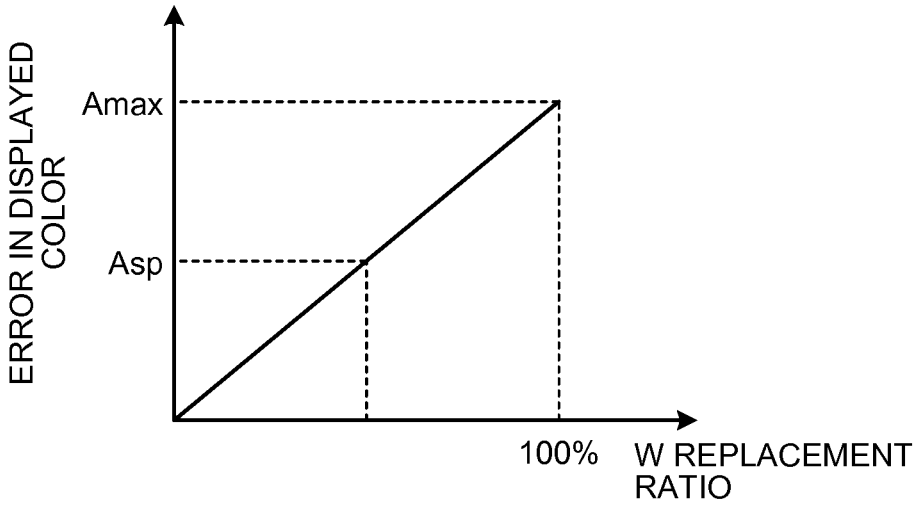
FIG. 11 is an explanatory diagram for explaining the method for displaying an image according to the embodiment.
Figure 12:
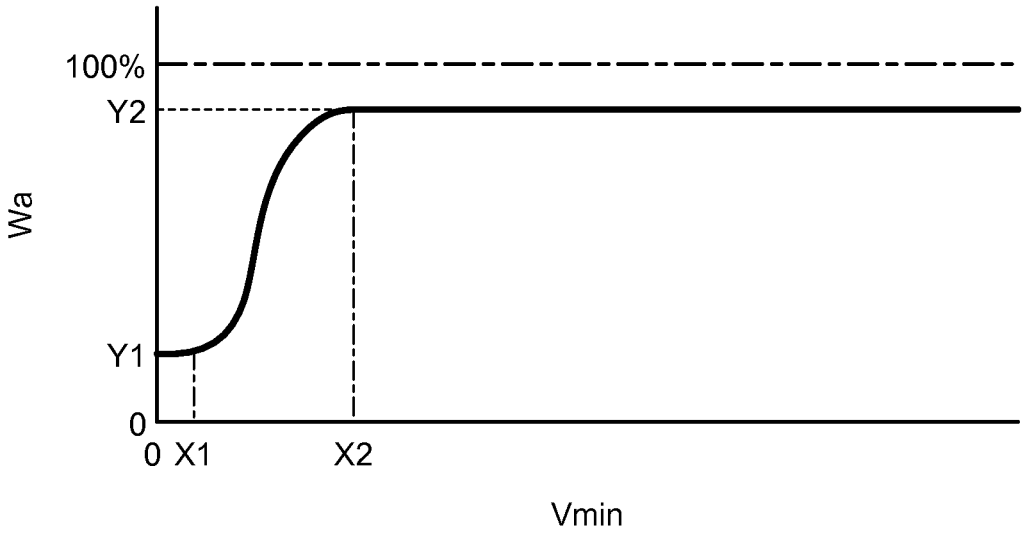
FIG. 12 is a graph illustrating an example of a relation between luminance and a gain of a white component.

Next, with reference to FIGS. 8 to 13D, the following describes processing operations performed by the display device 100, the conversion processing unit 10, the replacement ratio calculation unit 15, and the fourth sub-pixel signal processing unit 20. FIG. 8 is a flowchart for explaining a method for displaying an image according to the embodiment. FIGS. 9 to 11 are explanatory diagrams for explaining the method for displaying an image according to the embodiment. FIG. 12 is a graph illustrating an example of a relation between luminance and a gain of the white component. FIGS. 13A to 13D are explanatory diagrams illustrating an example of a relation between the signal and the replacement ratio (W replacement ratio in this embodiment).

In the display device 100, RGB input processing is performed such that an input image signal that is image data to be displayed on the display device 100 and serves as the first input signal SRGB1 including the first color information is input from a CPU and the like (Step S11). After the first input signal SRGB1 is input, the display device 100 performs RGB conversion processing by the conversion processing unit 10 (Step S12), and generates the second input signal SRGB2 from the first input signal SRGB1. Examples of the RGB conversion processing include, but are not limited to, color conversion processing and γ correction.

After performing the RGB conversion processing, the display device 100 performs W component extraction processing (Step S13). Specifically, based on the red (R) component, the green (G) component, and the blue (B) component of the second input signal SRGB2, a ratio (gradation number, quantity) of components that can be replaced with the white (W) component is extracted. The fourth sub-pixel signal processing unit 20 calculates the minimum value of the luminance of the red (R) component, the green (G) component, and the blue (B) component as the ratio (quantity) of components that can be replaced with the white (W) component. The ratio (gradation number, quantity) of components that can be replaced with the white (W) component is the total of the ratio (gradation number, quantity) of the components that can be replaced with the white (W) component in the red (R) component, the green (G) component, and the blue (B) component of the second input signal SRGB2. In the display device 100 according to the embodiment, the W component extraction processing is performed by the fourth sub-pixel signal processing unit 20. Alternatively, the W component extraction processing may be performed by the replacement ratio calculation unit 15.

The display device 100 determines the W replacement ratio based on the second input signal SRGB2 by the replacement ratio calculation unit 15 (Step S14). Specifically, the display device 100 determines a proportion (ratio) of components to be replaced with the white component as an output signal in the total of the ratio of components that can be replaced with the white (W) component extracted at Step S13. The W replacement ratio is a value of 0 (0%) to 1 (100%). Determination processing of the W replacement ratio will be described later.

After determining the W replacement ratio, the display device 100 performs RGBW signal processing for generating the extended value (third input signal SRGBW) of the extended HSV color space extended with the first color, the second color, the third color, and the fourth color based on the second color information of the second input signal SRGB2 and the determined W replacement ratio by the fourth sub-pixel signal processing unit 20 (Step S15). For example, the fourth sub-pixel signal processing unit 20 multiplies the W replacement ratio by the minimum value of the gradation values of the red (R) component, the green (G) component, and the blue (B) component to calculate the white (W) component, and subtracts the gradation value of the calculated white (W) component from the red (R) component, the green (G) component, and the blue (B) component of the second color information to generate the third input signal SRGBW.

In the display device 100, the fourth sub-pixel signal processing unit 20 outputs, to the drive circuit 40 that controls driving of the image display unit 30, the third input signal SRGBW including third color information obtained by converting red (R), green (G), and blue (B) components of the second color information into the red (R) component, the green (G) component, the blue (B) component, and the white (W) component serving as an additional color component, for example (Step S16). The display device 100 enables the image display unit 30 to display an image by performing the processing described above on each pixel.

Next, the following describes W replacement ratio determination processing at Step S14. The following example describes processing of determining the W replacement ratio assuming that, among signal values V(R), V(G), and V(B) of the respective red (R) component, the green (G) component, and the blue (B) component of the second input signal, the maximum value of the signal values is Vmax and the minimum value thereof is Vmin, and using the maximum value Vmax and the minimum value Vmin. The luminance of the red (R) component, the green (G) component, and the blue (B) component of the second input signal in the embodiment is represented in 0 to 255 gradation values. The signal value is 0 at the minimum, and 255 at the maximum. The gradation number is not limited to 256, and may be various values.

With reference to FIGS. 9 to 11, the following describes an example of the determination processing of the W replacement ratio. The display device 100 can output the white (W) component as an additional color component by combining the red (R) component, the green (G) component, and the blue (B) component. In this case, when the display device 100 displays the color of the white (W) component, an error occurs between a color that is displayed as a combination of the red (R) component, the green (G) component, and the blue (B) component using the first sub-pixel 32R, the second sub-pixel 32G, and the third sub-pixel 32B, and a color that is displayed with the white (W) component using the fourth sub-pixel 32W, due to characteristics of the sub-pixels. FIG. 9 illustrates a relation between a W component quantity (magnitude of the minimum value Vmin) and the error between W and RGB. The W component quantity is magnitude of color that is replaced with white to be output. As the W component quantity increases, the luminance of white is increased. The W component quantity is calculated from the minimum value Vmin of the signal values, so that the value of the W component quantity corresponds to the minimum value Vmin of the signal values. The error between W and RGB is an error between the color displayed using the fourth sub-pixel 32W and the color displayed using the combination of the first sub-pixel 32R, the second sub-pixel 32G, and the third sub-pixel 32B. An error Asp is a permissible value of the error (hereinafter, referred to as a permissible error Asp).

As illustrated in FIG. 9, in the display device 100 according to the embodiment, a small W component quantity causes a large error. As the W component quantity increases, the error is reduced in a range from a certain W component quantity W1 to a W component quantity W2 that is larger than W1. When the W component quantity is larger than W2, a small error that is substantially constant is caused in the display device 100. When the W component quantity reaches W3 that is larger than W2, the error becomes the permissible error Asp as the permissible value. When the W component quantity is larger than W3, the error becomes equal to or smaller than the permissible error Asp.

Based on this error, when a relation between the minimum value Vmin of the signal values and the luminance of the white (W) component using the fourth sub-pixel 32W is set so that the error is constant (for example, the permissible error Asp) in consideration of an error in white alone, an ideal relation illustrated with the dotted line in FIG. 10 is obtained. In this case, as illustrated in FIG. 10, the minimum value Vmin of the signal values and the luminance are in a proportional relation, for example. However, as illustrated in FIG. 9, when the minimum value Vmin of the signal values is smaller than W3, that is, the white (W) component is small, the error is increased between the white (W) component displayed using only the fourth sub-pixel 32W and the white (W) component displayed using only the first sub-pixel 32R, the second sub-pixel 32G, and the third sub-pixel 32B. Accordingly, when the minimum value Vmin of the signal values is small, the luminance of the white (W) component using the fourth sub-pixel 32W is reduced to reduce the error as illustrated with the solid line in FIG. 10. By the reduction in luminance of the white (W) component using the fourth sub-pixel 32W, white is displayed using the first sub-pixel 32R, the second sub-pixel 32G, and the third sub-pixel 32B.

When the display device 100 displays a color other than white, any of the signal values of the red (R) component, the green (G) component, and the blue (B) component exceeds the minimum value Vmin, and the luminance of the color to be displayed is higher than that of the white (W) component. For example, even when the white component depending on the minimum value Vmin is W1 or W2 in FIG. 10, the luminance of the color to be displayed may be $B_3$ when the color of any other component is large. In such a case, the ratio of the luminance of white with respect to the entire luminance becomes smaller because a component other than white is added, so that the error between the luminance of the fourth sub-pixel 32W and the entire luminance of the first sub-pixel 32R, the second sub-pixel 32G, the third sub-pixel 32B, and the fourth sub-pixel 32W can be reduced to be smaller than the permissible value even when the white component is displayed by using the fourth sub-pixel 32W. This relation enables, even when the error tends to be large between the white (W) component displayed using only the fourth sub-pixel 32W and the white (W) component displayed using only the first sub-pixel 32R, the second sub-pixel 32G, and the third sub-pixel 32B because the minimum value Vmin of the signal values is small, the display device 100 to increase the luminance of the fourth sub-pixel 32W in a range not exceeding the permissible value of the error.

Specifically, the display device 100 calculates a relation between a W replacement percentage and an error in displayed color illustrated in FIG. 11 based on the color to be displayed, and calculates the W replacement ratio so that the error in display color is equal to or smaller than the permissible error Asp based on the calculated relation. In this case, the permissible error Asp illustrated in FIG. 11 is a value calculated as follows: {(luminance of W component of input signal)/(luminance of entire input signal)}×(error between W and RGB). That is, the permissible error Asp is a value that varies according to a ratio of the luminance of the W component of the input signal to the luminance of the entire input signal, and the error between W and RGB corresponding to the ratio of the W component of the input signal. In other words, the permissible error Asp may be a value calculated as follows: {(luminance of W component of input signal)/(luminance of components other than W component of input signal)}×(error between W and RGB). That is, the permissible error Asp is a value that varies according to a ratio of the luminance of the W component of the input signal to the luminance of components other than the W component of the input signal, and the error between W and RGB corresponding to the ratio of the W component of the input signal. The luminance of the W component of the input signal is the luminance of white of the minimum value Vmin of the signal values.

Based on the relation illustrated in FIG. 11, the display device 100 determines the W replacement ratio in a range in which the error in displayed color is equal to or smaller than the permissible error Asp as a permissible value. Preferably, the W replacement ratio is determined so that the error is equal to or smaller than the permissible error Asp and included in a permissible range close to the permissible error Asp.

By determining the W replacement ratio based on the relation in FIG. 11, the display device 100 can cause the error to be equal to or smaller than the permissible value. By determining the W replacement ratio based on the relation in FIG. 11, the display device 100 can increase the W replacement ratio while maintaining the error in displayed color equal to or smaller than the permissible error Asp as compared to a case of determining the W replacement ratio so that the error in displayed color is equal to or smaller than the permissible error Asp based on the relation illustrated in FIG. 9.

The following describes a specific example of a calculation method. The replacement ratio calculation unit 15 stores a relation between the minimum value Vmin and a gain value (Wa value) of the W component as illustrated in FIG. 12. The minimum value Vmin in the embodiment is the total of the signal values (gradation numbers) that can be replaced with the white (W) component. In FIG. 12, the vertical axis indicates the gain value Wa, and the horizontal axis indicates the minimum value Vmin of the signal values. In the relation illustrated in FIG. 12, a value Y1 is set as an offset value, and the Wa value is equal to or larger than Y1. When the minimum value Vmin of the signal values is 0 to X1, that is, when the minimum value of the luminance is small, the gain value Wa slightly increases from Y1 as the minimum value of the luminance increases. When the minimum value Vmin of the signal values is X1 to X2, the Wa value abruptly increases as the minimum value of the luminance increases. When the minimum value Vmin of the signal values is X2, the gain value Wa is Y2. When the minimum value Vmin of the signal values is larger than X2, the Wa value is constantly Y2. The relation between the minimum value Vmin of the signal values and the gain value Wa of the W component is not limited thereto. The gain value Wa in a case where the minimum value of the signal values is larger than a second certain value is preferably larger than the gain value Wa in a case where the minimum value of the signal values is smaller than a first certain value. The second certain value is larger than the first certain value. It is preferred that the gain value Wa abruptly increases in a certain range in which the minimum value Vmin of the signal values is relatively small, and tends to come closer to 100% as the minimum value Vmin increases thereafter. The offset value Y1 is a certain value equal to or larger than 0.

The replacement ratio calculation unit 15 calculates a W replacement ratio Wr using the relation about the gain value Wa illustrated in FIG. 12. For example, the replacement ratio calculation unit 15 calculates the W replacement ratio Wr using the following expression.

$$Wr=Wa+Wb$$

Herein, Wb is an adjustment term. That is, the W replacement ratio Wr in the embodiment is calculated by adding the adjustment term Wb to the gain value Wa determined with the minimum value of the luminance. The adjustment term Wb is calculated as follows: Wb=f(x)×g(x). The value f(x) is calculated based on a difference between the minimum value Vmin and the maximum value Vmax of the signal values. An offset value that can be adjusted by a user may be added to f(x). The value f(x) is a term that varies according to a value of (Vmax−Vmin) of the second input signal (pixel data), and comes closer to 1 when the difference between the maximum value Vmax and the minimum value Vmin is large. The value g(x) is a term that varies according to the gain value Wa. The value g(x) is reduced and an adjustment amount comes closer to zero in a region where the gain value Wa is high, and g(x) comes closer to 1 in a region where the gain value Wa is low.

Accordingly, the adjustment term Wb is a small value in a region where the gain value Wa is high or a region where the difference between the maximum value Vmax and the minimum value Vmin is small. On the other hand, the adjustment term Wb is a large value in a region where the gain value Wa is low and the difference between the maximum value Vmax and the minimum value Vmin is large. Due to this, the adjustment term Wb is larger than the gain value Wa in a region where the gain value Wa is low and the difference between the maximum value Vmax and the minimum value Vmin is large, which increases a contribution ratio to the W replacement ratio Wr (influence on the replacement ratio).

The display device 100 determines the W replacement ratio Wr using the replacement ratio calculation unit 15, and generates the third color information based on the determination. Due to this, as illustrated in FIGS. 13A to 13D, the W replacement ratio Wr can be varied according to balance between colors of the second color information.

Figure 13A:
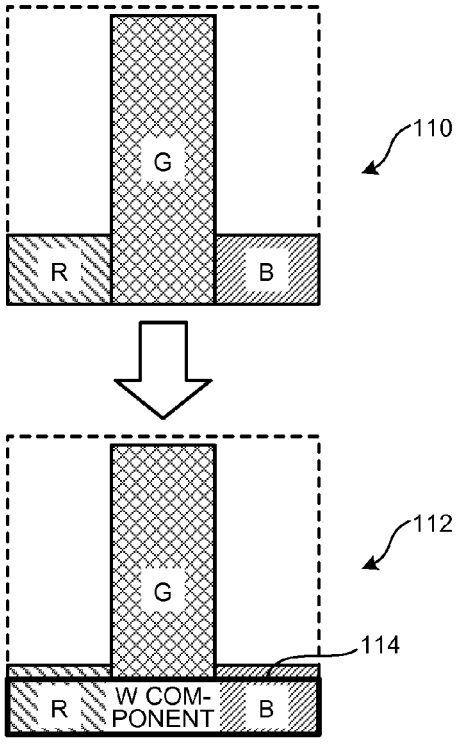
FIG. 13A is an explanatory diagram illustrating an example of a relation between a signal and a replacement ratio.

For example, when the second color information indicates the signal value of the green (G) component is high, the luminance of the red (R) component and the blue (B) component is low, and a difference between the luminance of the green (G) component and the signal values of the red (R) component and the blue (B) component is large as illustrated in color balance 110 of FIG. 13A, the minimum value of the signal values is small (close to X1 in FIG. 12) but the difference between the signal values is large. In this case, although the gain value Wa is small, the adjustment term Wb is large, so that the W replacement ratio Wr becomes large. Accordingly, as illustrated in color balance 112, a ratio of components to be replaced with the white (W) component in the red (R) component, the green (G) component, and the blue (B) component is calculated to be high, and a large part of the red (R) component and the blue (B) component is replaced with the white (W) component as represented as a region 114.

Figure 13B:
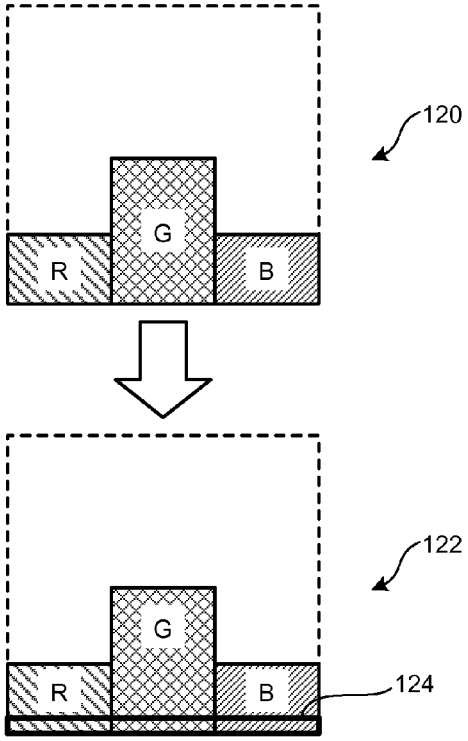
FIG. 13B is an explanatory diagram illustrating an example of the relation between the signal and the replacement ratio.

Next, when the second color information indicates the signal value of the green (G) component is medium, the signal values of the red (R) component and the blue (B) component are low, and the difference between the luminance of the green (G) component and the signal values of the red (R) component and the blue (B) component is small as illustrated in color balance 120 of FIG. 13B, the minimum value of the signal values is small (close to X1 in FIG. 12) and the difference between the signal values is also small. In this case, the gain value Wa is small and the adjustment term Wb is small, so that the W replacement ratio Wr becomes small. Accordingly, as illustrated in color balance 122, a ratio of components to be replaced with the white (W) component in the red (R) component, the green (G) component, and the blue (B) component is calculated to be low, and the ratio of components to be replaced with the white (W) component in the red (R) component, the green (G) component, and the blue (B) component becomes low as represented as a region 124.

Figure 13C:
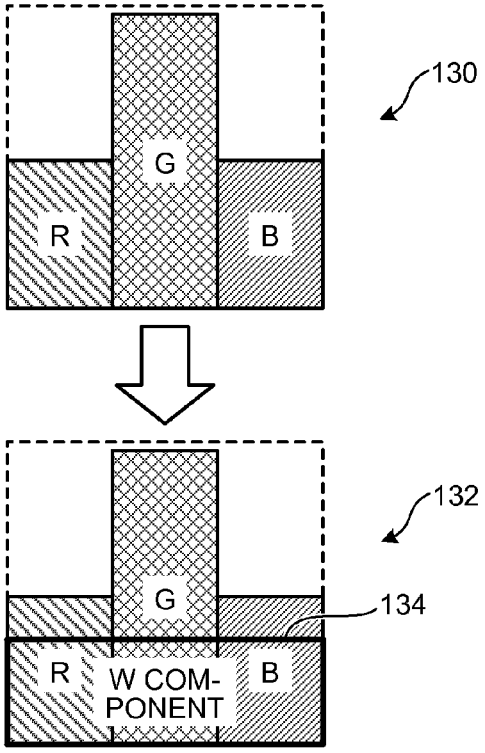
FIG. 13C is an explanatory diagram illustrating an example of the relation between the signal and the replacement ratio.

Next, when the second color information indicates the signal value of the green (G) component is high, the signal values of the red (R) component and the blue (B) component are medium, and the difference between the signal value of the green (G) component and the signal values of the red (R) component and the blue (B) component is medium as illustrated in color balance 130 of FIG. 13C, the minimum value of the signal values is medium (between X1 and X2 in FIG. 12) and the difference between the signal values is also medium. In this case, the gain value Wa is medium and the adjustment term Wb is medium, so that the W replacement ratio Wr is medium. Accordingly, as illustrated in color balance 132, a ratio of components to be replaced with the white (W) component in the red (R) component, the green (G) component, and the blue (B) component is calculated to be medium, and part of the red (R) component and the blue (B) component is replaced with the white (W) component as represented as a region 134. A medium signal value means a signal value that is higher than the color component having low luminance in FIG. 13A and lower than the color component having a high signal value.

Figure 13D:
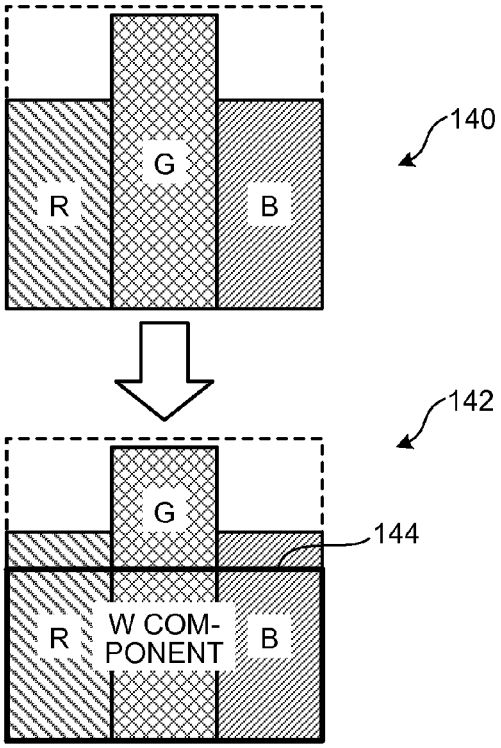
FIG. 13D is an explanatory diagram illustrating an example of the relation between the signal and the replacement ratio.

Next, when the second color information indicates the signal value of the green (G) component is high, the signal values of the red (R) component and the blue (B) component are also high, and the difference between the signal value of the green (G) component and the signal values of the red (R) component and the blue (B) component is small as illustrated in color balance 140 of FIG. 13D, the minimum value of the signal values is high (higher than X2 in FIG. 12) and the difference between the signal values is small. In this case, the gain value Wa is high and the adjustment term Wb is low, so that the W replacement ratio Wr becomes high. Accordingly, as illustrated in color balance 142, a ratio of components to be replaced with the white (W) component in the red (R) component, the green (G) component, and the blue (B) component is calculated to be high, and a large part of the red (R) component and the blue (B) component is replaced with the white (W) component as represented as a region 144.

The display device 100 adjusts the ratio of components to be replaced with the white (W) component, that is, an additional color component using the W replacement ratio calculated by the replacement ratio calculation unit 15, and converts an RGB signal into an RGBW signal. Accordingly, the display device 100 can display an image using the fourth sub-pixel 32W of the white (W) component having a high signal value, so that a lighting rate in the sub-pixel 32 can be reduced. That is, the display device 100 displays an image using the fourth sub-pixel 32W that can output high luminance with lower electric power as compared with other colors, and reduces the luminance of light output from the first sub-pixel 32R, the second sub-pixel 32G, and the third sub-pixel 32B, so that power consumption can be reduced.

Performing conversion while adjusting components of respective colors with the replacement ratio calculation unit 15 and the fourth sub-pixel signal processing unit 20 can maintain the image to be displayed even when the fourth sub-pixel 32W is used.

By adjusting the ratio of components to be replaced with the white (W) component, that is, an additional color component using the W replacement ratio calculated by the replacement ratio calculation unit 15, the display device 100 can reduce the ratio of components to be converted into the fourth sub-pixel in a region where performing replacement increases an error between an input image and the image to be displayed, based on a characteristic difference between gradation value (signal value) and luminance, a characteristic difference between the gradation value (signal value) and a viewing angle, and a characteristic difference between sub-pixels that spontaneously emit light, each characteristic difference existing between the first sub-pixel, the second sub-pixel, and the third sub-pixel and the fourth sub-pixel. This procedure can prevent the error between colors of the input image and the image to be displayed from being increased, prevent visibility from being changed, and reduce the power consumption.

By determining the W replacement ratio using the adjustment term Wb in addition to the gain value Wa of the W component that varies according to the minimum value of the luminance with the replacement ratio calculation unit 15, the display device 100 can increase the W replacement ratio when a certain condition is satisfied, specifically, when the saturation is high, even in a region where the W replacement ratio is calculated to be low with the gain value Wa. Accordingly, when the saturation is high, specifically, when the luminance of any color component is high, the W replacement ratio can be increased and the power consumption can be further reduced. In an image (pixel) having high saturation, the color of the pixel having high saturation is dominant, so that variation in color to be recognized is not easily recognized even when some components are replaced with the white (W) component. By increasing the ratio of components to be replaced with the white (W) component, the pixel having high saturation can prevent a single color from being overflown and saturated to cause a color shift when the luminance is expanded. As described above, the display device 100 can prevent the error in color from being increased, and prevent visibility from being changed. That is, the display device 100 can reduce the power consumption while maintaining display quality of the image to be displayed.

The values f(x) and g(x) may be calculated by multiplying the saturation S by the signal value, by using the saturation S in place of the signal value, or by using a square of the saturation S. The use of the saturation S can adjust the contribution ratio of the adjustment term. The saturation S is, for example, obtained by subtracting the minimum value from the maximum value of the signal values, and dividing the subtraction result by the maximum value.

The replacement ratio calculation unit 15 can preferably switch f(x) and g(x) according to a mode, that is, select f(x) and g(x) according to a mode. In this case, the replacement ratio calculation unit 15 may be provided with a mode in which f(x) and g(x) are set at 0, that is, the adjustment term Wb is 0 so that the gain value Wa determined with the minimum value of the luminance is the W replacement ratio. Enabling the mode to be switchable makes the ratio of the white (W) component in output data adjustable according to user's use.

The display device 100 may select a mode according to a gain that is set when the luminance is adjusted by a user or by limiting electric power. Processing of determining the mode based on the gain may be performed by any part of the display device 100. The gain means a luminance ratio (register) with respect to the maximum luminance that can be displayed with the image display panel.

In the embodiment, the maximum value and the minimum value of the signal values are used to calculate the adjustment term Wb. However, the embodiment is not limited thereto. An intermediate value Vmid of the signal values of respective color components may be used in place of the minimum value of the signal values, for example. As the intermediate value Vmid, a signal value of a color component to be an intermediate signal value may be used, or an average value of color components of all colors may be used.

The operation performed by the replacement ratio calculation unit 15 is not limited to determining (adjusting) the W replacement ratio based on the signal value. The replacement ratio calculation unit 15 may determine (adjust) the W replacement ratio using a luminance ratio between the white (W) component and the other color components as a parameter. For example, when the second color information is assumed to be a signal of the HSV space, the replacement ratio calculation unit 15 obtains a luminance ratio between luminance (a) of the second color information and luminance (b) of the white (W) component included in the second color information using a signal value V (represented in 0 to 255 gradation values in the embodiment) of each color to determine the W replacement ratio. In this case, signal values of respective colors in the second color information are assumed to be V(R), V(G), and V(B). A luminance coefficient of R is assumed to be rr, a luminance coefficient of G is assumed to be gg, and a luminance coefficient of B is assumed to be bb. In this case, the luminance (a) of the second color information and the luminance (b) of the white (W) component can be represented by the following expressions.

$$(a)=V(R)\times rr+V(G)\times gg+V(B)\times bb$$

$$(b)=\mathrm{Vmin(RGB)}\times ww$$

Herein ww is a luminance coefficient of W, and ww=rr+gg+bb is satisfied.

The replacement ratio calculation unit 15 may calculate the adjustment term Wb using the luminance (a) of the second color information and the luminance (b) of the white (W) component.

Next, the replacement ratio calculation unit 15 may determine (adjust) the W replacement ratio using the maximum value Vmax, the intermediate value Vmid, and the minimum value Vmin. In this case, the following expressions can be used as the parameter: Vmin/(Vmax+Vmid+Vmin); (Vmax−Vmin)+(Vmid−Vmin); and (Vmin/Vmax). The replacement ratio calculation unit 15 may calculate the adjustment term Wb using the expression of Vmin/(Vmax+Vmid+Vmin). The replacement ratio calculation unit 15 may calculate the adjustment term Wb using the expression of (Vmax−Vmin)+(Vmid−Vmin). By calculating the adjustment term Wb using the above parameters, when the second color information satisfies a certain condition similarly to the embodiment, the adjustment term Wb can be a high value and the W replacement ratio can be increased. When using the saturation, the replacement ratio calculation unit 15 may compare the gain value Wa with f(x) to determine a larger value as the W replacement ratio.

The replacement ratio calculation unit 15 may calculate the W replacement ratio using the saturation and the hue in place of the luminance. In this way, the replacement ratio calculation unit 15 adjusts the W replacement ratio based on the luminance, the brightness, the saturation, and/or the hue of the second color information to adjust a ratio of replacement of components with the white (W) component at a ratio corresponding to balance of the color information. Accordingly, the power consumption can be reduced while a preferred image is displayed.

The replacement ratio calculation unit 15 calculates the W replacement ratio based on the second color information of the corresponding pixel 31. Alternatively, the replacement ratio calculation unit 15 may adjust the W replacement ratio using another piece of information. For example, the replacement ratio calculation unit 15 may detect gradation, saturation distribution, and the like from a target image to correct the W replacement ratio based on the calculated gradation and the saturation distribution.

The replacement ratio calculation unit 15 may correct the W replacement ratio based on balance of the entire image (entire screen) or power consumption. Specifically, the replacement ratio calculation unit 15 may change the W replacement ratio based on luminance information of the entire image. For example, the W replacement ratio may be set to be high for an image having a high lighting rate (luminance), and for an image having a low lighting rate, no replacement may be performed or the W replacement ratio may be set to be low. When a luminance gain is applied, whether adjustment with the W replacement ratio is performed may be determined depending on the luminance gain. Specifically, when the gain is large, the adjustment with the W replacement ratio may be performed. The replacement ratio calculation unit 15 may change the W replacement ratio using saturation information of the entire image. For example, an image having high saturation may be adjusted using the W replacement ratio. The replacement ratio calculation unit 15 may determine whether the image is a moving image or a static image, and change the W replacement ratio to be calculated, that is, switch the mode depending on whether the displayed image is a moving image or a static image. The replacement ratio calculation unit 15 may determine whether the image includes a particular color that is easily deteriorated in terms of temperature or reliability, and increase the W replacement ratio if the image includes the color that is easily deteriorated.

When determining that the image is an image to which power limit is applied, that is, an image that needs to be displayed by reducing the luminance and the like as a whole under present circumstances, the replacement ratio calculation unit 15 may calculate the W replacement ratio with setting which makes the W replacement ratio high. When determining that the image to be displayed is an image having a low power reduction rate, such as an image having a small number of W components, the replacement ratio calculation unit 15 may reduce circuit power consumption without calculating the W replacement ratio.

When a gain is applied to the input signal (color information) from the outside, the display device preferably applies the gain to a current frame in real time, or applies the gain to the next frame. Accordingly, the W replacement ratio of the output signal can be kept constant, and the display device can cope with a dynamic change. Examples of the gain from the outside include, but are not limited to, a gain set by a user or power limit as described above. When RGBW conversion processing is performed after the gain is applied to the input data, the processing can be performed without selecting a mode.

The display device may adjust the W replacement ratio according to the hue. For example, even when the maximum value and the minimum value of the signal values are the same, the W replacement ratio may vary depending on whether Vmax is R, G, or B. Accordingly, the display device can perform replacement with the white pixel according to the hue, and increase the W replacement ratio while reducing an error ratio.

In the above embodiment, the conversion processing unit 10 converts the first color information into the second color information. However, the embodiment is not limited thereto. The display device 100 may input the first color information to the fourth sub-pixel signal processing unit 20 without performing conversion by the conversion processing unit 10, calculate the W replacement ratio based on the first color information, and perform RGBW signal processing.

Figure 14:
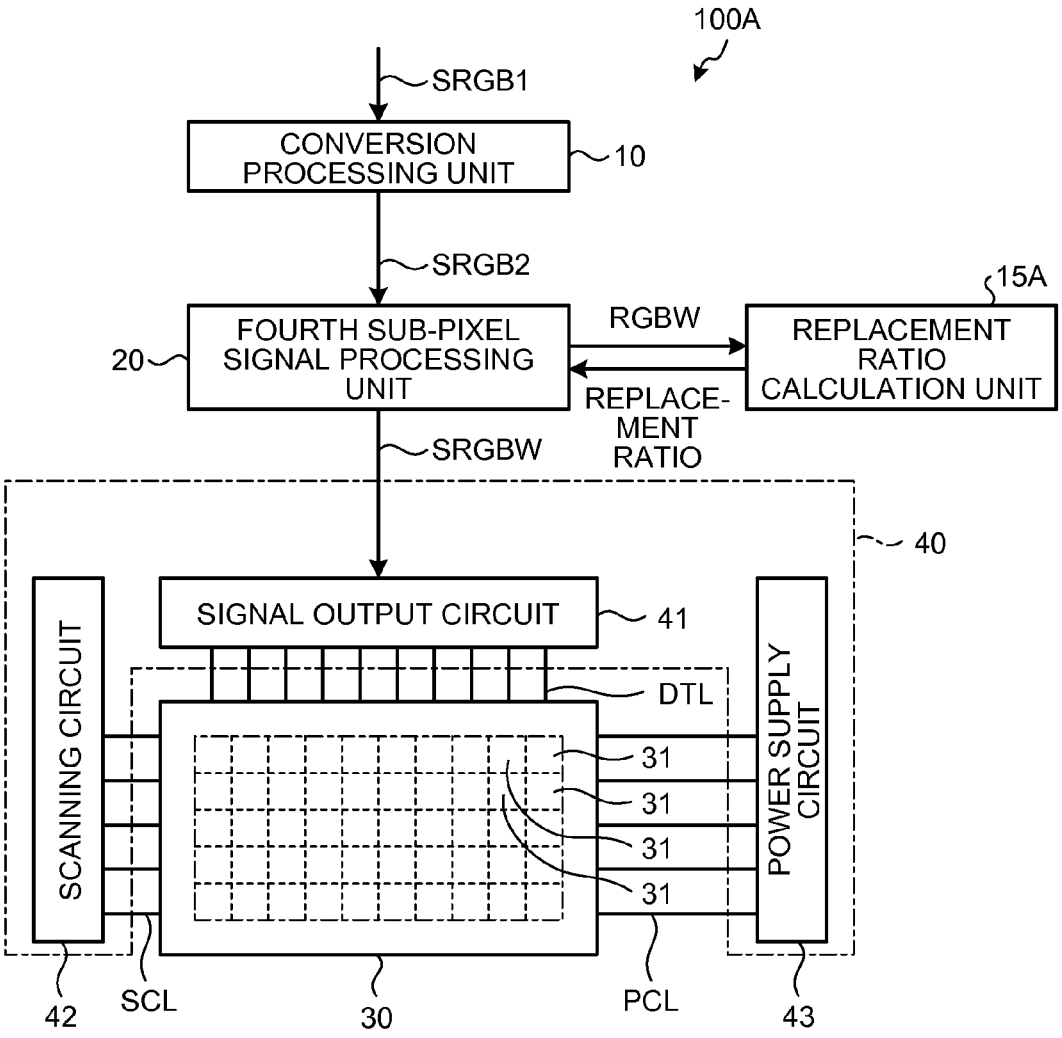
FIG. 14 is a block diagram illustrating an example of a configuration of a display device according to another embodiment.
Figure 15:
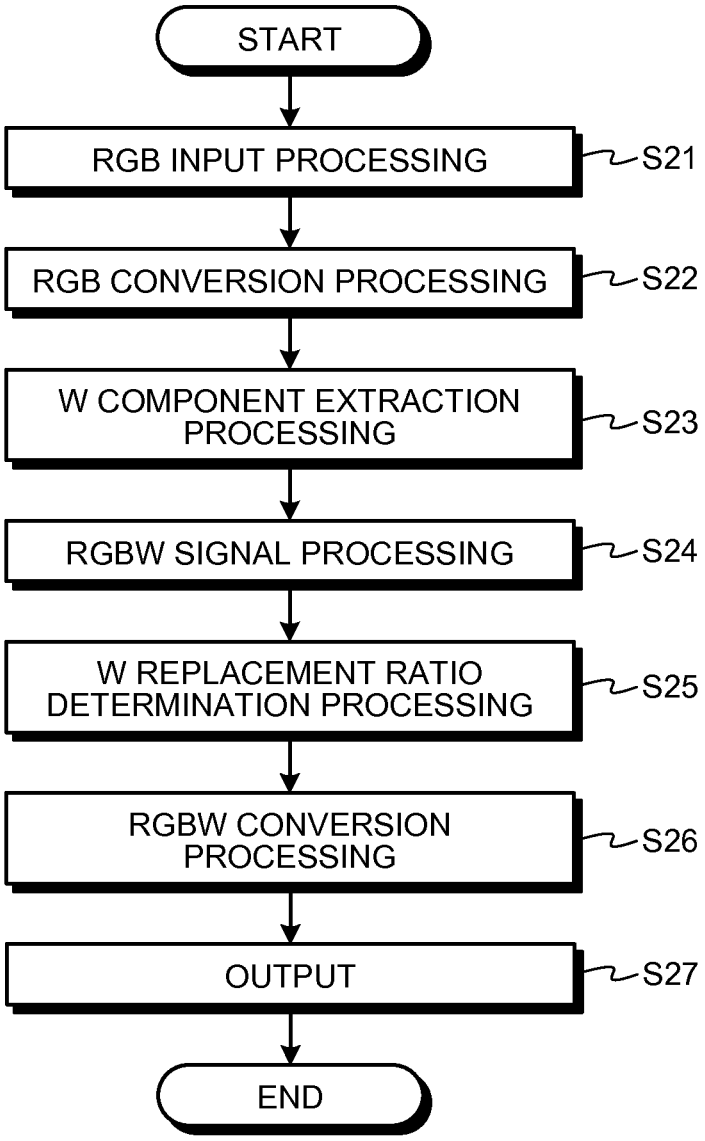
FIG. 15 is a flowchart for explaining a method for displaying an image according to another embodiment.

FIG. 14 is a block diagram illustrating an example of a configuration of the display device according to another embodiment. FIG. 15 is a flowchart for explaining the method for displaying an image according to another embodiment. The same components as those described in the above embodiment are denoted by the same reference numerals, and redundant description will not be repeated.

In a display device 100A illustrated in FIG. 14, a replacement ratio calculation unit 15A calculates the W replacement ratio based on a temporary input signal RGBW, and inputs the calculated W replacement ratio to the fourth sub-pixel signal processing unit 20. The temporary input signal RGBW (a converted input signal including converted color information) is generated by the fourth sub-pixel signal processing unit 20, and part of the red (R), green (G), and blue (B) components is replaced with the white (W) component. Based on the W replacement ratio input to the fourth sub-pixel signal processing unit 20, the fourth sub-pixel signal processing unit 20 corrects the temporary input signal RGBW output to the replacement ratio calculation unit 15A, and generates and outputs an output signal SRGBW.

The following describes an example of a processing operation with reference to FIG. 15. In the display device 100A, RGB input processing is performed such that an input image signal that is image data to be displayed on the display device 100A and serves as the first input signal SRGB1 including the first color information is input from a CPU and the like (Step S21). After receiving the first input signal SRGB1, the display device 100A performs RGB conversion processing by the conversion processing unit 10 (Step S22), and generates the second input signal SRGB2 from the first input signal SRGB1. Examples of the RGB conversion processing include, but are not limited to, color conversion processing and γ correction.

After performing RGB conversion processing, the display device 100A performs W component extraction processing (Step S23). After performing W component extraction processing, the display device 100A performs RGBW signal processing, by the fourth sub-pixel signal processing unit 20, for converting the second color information of the second input signal SRGB2 into the extended value (temporary input signal RGBW) of the extended HSV color space extended with the first color, the second color, the third color, and the fourth color to generate the temporary input signal RGBW(Step S24).

After performing RGBW signal processing to generate the temporary input signal RGBW, the display device 100A determines the W replacement ratio based on the temporary input signal RGBW by the replacement ratio calculation unit 15A (Step S25). The W replacement ratio is determined based on the temporary input signal RGBW and data gain set by an input from the outside or due to various conditions.

After determining the W replacement ratio, the display device 100A performs RGBW conversion processing, by the fourth sub-pixel signal processing unit 20, for correcting the temporary input signal RGBW based on the W replacement ratio, and for converting the corrected temporary input signal RGBW into the extended value (third input signal SRGBW) of the extended HSV color space extended with the first color, the second color, the third color, and the fourth color to generate the third input signal SRGBW as an output signal (Step S26). The fourth sub-pixel signal processing unit 20 corrects the temporary input signal RGBW using the W replacement ratio, and then performs processing for converting the signal with the gain and the like to generate the third input signal SRGBW.

In the display device 100A, the fourth sub-pixel signal processing unit 20 outputs the third input signal SRGBW including the third color information that is converted from the red (R), green (G), and blue (B) components of the second color information and includes the red (R) component, the green (G) component, the blue (B) component, and the white (W) component serving as an additional color component, for example, to the drive circuit 40 that controls driving of the image display unit 30 (Step S27). The display device 100A can display an image on the image display unit 30 by performing the above processing on each pixel.

As described above, when the gain is applied to the signal replaced with the white (W) component, a portion corresponding to the data gain can be returned by calculating the W replacement ratio in consideration of the gain and the temporary input signal including the white component as in the embodiment, and the W replacement ratio can be made proper.

In the above embodiment, the display device 100, 100A incorporates the replacement ratio calculation unit 15, 15A. However, the embodiment is not limited thereto. In the display device 100, 100A, the replacement ratio calculation unit 15, 15A may be arranged on the outside of the device, for example, in a CPU for inputting the input video signal (an arithmetic unit of an electronic apparatus including the display device 100, 100A).

When there is a deviation of the hue in the first color information for performing image analysis on the input video signal to be displayed on all the pixels, the conversion processing unit 10 adds a correction amount based on the center of the deviation of the hue to the first color information to be displayed on a certain pixel, and converts the first color information into the second color information. Accordingly, when there is a deviation of the hue in the entire image, a saturation attenuation amount is reduced and the error in color is hardly recognized.

In the embodiment, the first sub-pixel to the fourth sub-pixel are assumed to be sub-pixels emitting light of four colors such as the red (R) component, the green (G) component, the blue (B) component, and the white (W) component. However, the embodiment is not limited thereto. As the first sub-pixel to the third sub-pixel, the display device can use various combinations that can display an additional color component by mixing the first color component, the second color component, and the third color component emit from each sub-pixel. It is sufficient that the fourth sub-pixel has higher luminance or higher power efficiency for display than that of the first sub-pixel to the third sub-pixel, and can output an additional color component. It is sufficient that the additional color component is different from the first color component, the second color component, and the third color component.

APPLICATION EXAMPLE

The following describes application examples of the display device 100 described above with reference to FIGS. 16 to 24. The following describes a case in which the display device 100 according to the embodiment is applied, and the same applies to the display device 100A according to another embodiment. FIGS. 16 to 24 are diagrams each illustrating an example of an electronic apparatus to which the display device according to the embodiment is applied. The display device 100 according to the embodiment can be applied to electronic apparatuses in various fields such as portable terminal devices including cellular telephones and smartphones, television apparatuses, digital cameras, notebook personal computers, video cameras, or meters mounted on a vehicle. In other words, the display device 100 according to the embodiment can be applied to electronic apparatuses in various fields that display a video signal input from the outside or a video signal generated inside as an image or video. The electronic apparatus includes a control device that supplies a video signal to the display device 100 and controls an operation of the display device 100.

Application Example 1

Figure 16:
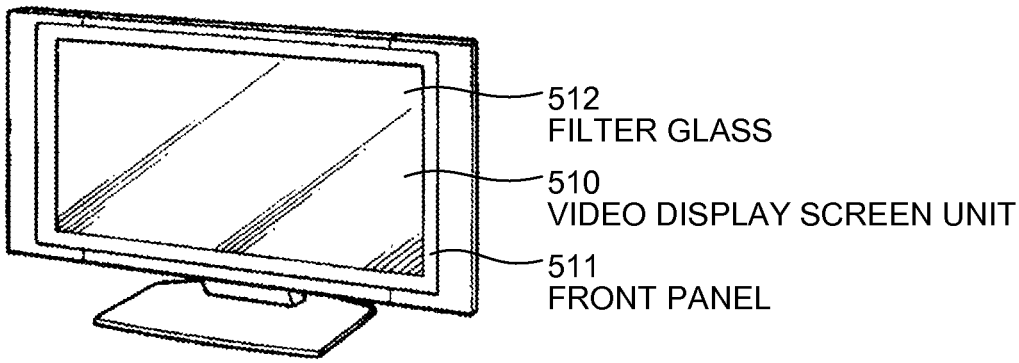
FIG. 16 is a diagram illustrating an example of an electronic apparatus to which the display device according to the embodiment is applied.

The electronic apparatus illustrated in FIG. 16 is a television apparatus to which the display device 100 according to the embodiment is applied. The television apparatus includes, for example, a video display screen unit 510 including a front panel 511 and a filter glass 512, and the video display screen unit 510 is the display device 100 according to the embodiment.

Application Example 2

Figure 17:
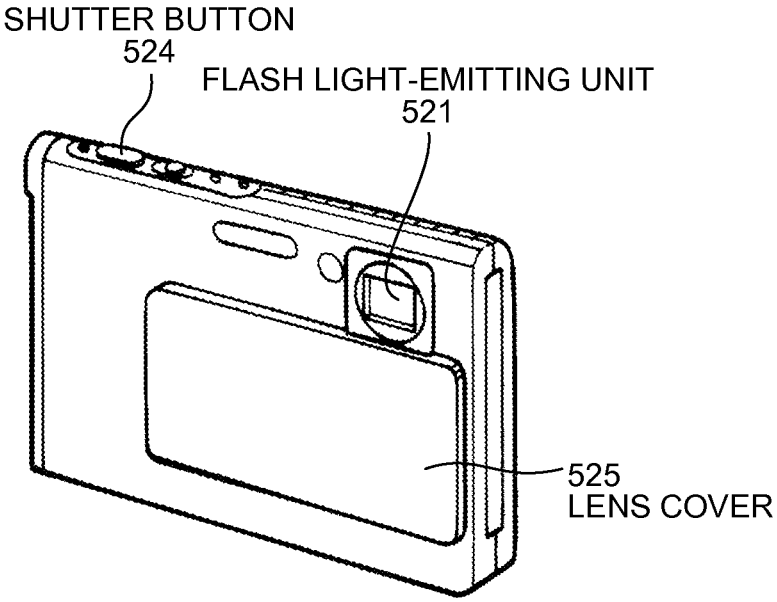
FIG. 17 is a diagram illustrating an example of an electronic apparatus to which the display device according to the embodiment is applied.
Figure 18:
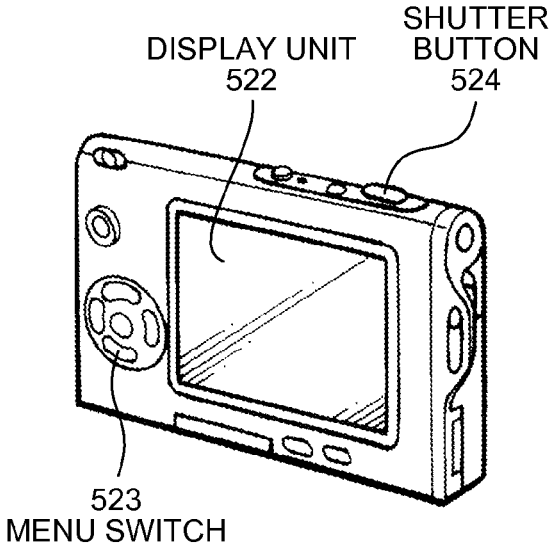
FIG. 18 is a diagram illustrating an example of the electronic apparatus to which the display device according to the embodiment is applied.

The electronic apparatus illustrated in FIGS. 17 and 18 is a digital camera to which the display device 100 according to the embodiment is applied. The digital camera includes, for example, a flash light-emitting unit 521, a display unit 522, a menu switch 523, and a shutter button 524, and the display unit 522 is the display device 100 according to the embodiment. As illustrated in FIG. 17, the digital camera includes a lens cover 525, and a photographing lens appears when the lens cover 525 is slid. The digital camera images incident light from the photographing lens to take a digital photograph.

Application Example 3

Figure 19:
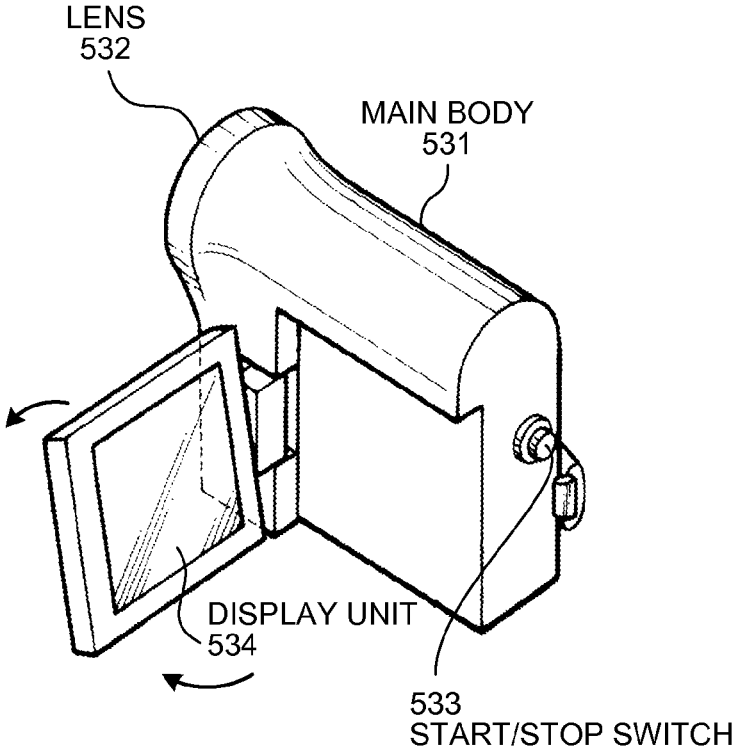
FIG. 19 is a diagram illustrating an example of an electronic apparatus to which the display device according to the embodiment is applied.

The electronic apparatus illustrated in FIG. 19 represents an external appearance of a video camera to which the display device 100 according to the embodiment is applied. The video camera includes, for example, a main body 531, a lens 532 for photographing a subject arranged on a front side surface of the main body 531, a start/stop switch 533 for photographing, and a display unit 534. The display unit 534 is a display device 100 according to the embodiment.

Application Example 4

Figure 20:
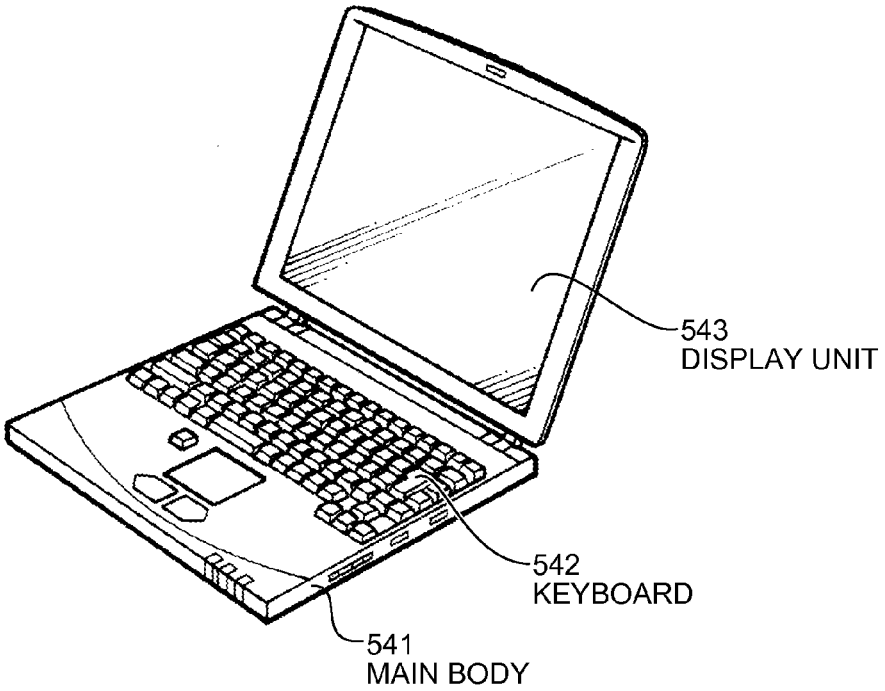
FIG. 20 is a diagram illustrating an example of an electronic apparatus to which the display device according to the embodiment is applied.

The electronic apparatus illustrated in FIG. 20 is a notebook personal computer to which the display device 100 according to the embodiment is applied. The notebook personal computer includes, for example, a main body 541, a keyboard 542 for inputting characters and the like, and a display unit 543 for displaying an image, and the display unit 543 is the display device 100 according to the embodiment.

Application Example 5

Figure 21:
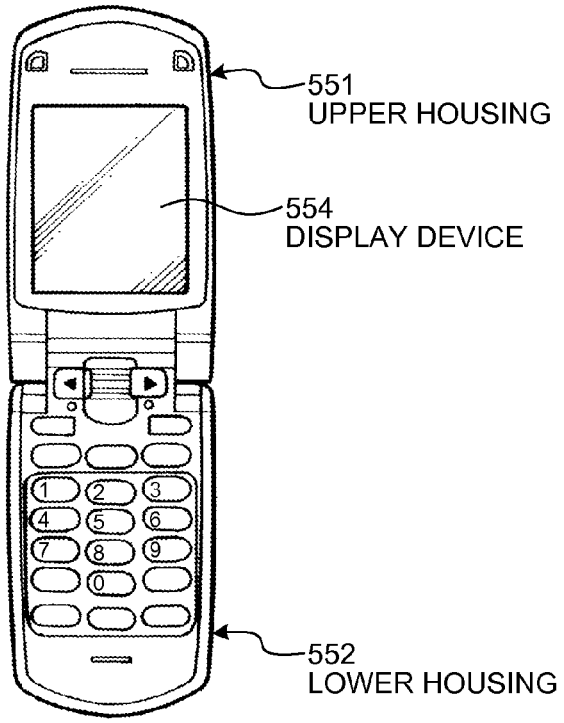
FIG. 21 is a diagram illustrating an example of an electronic apparatus to which the display device according to the embodiment is applied.
Figure 22:
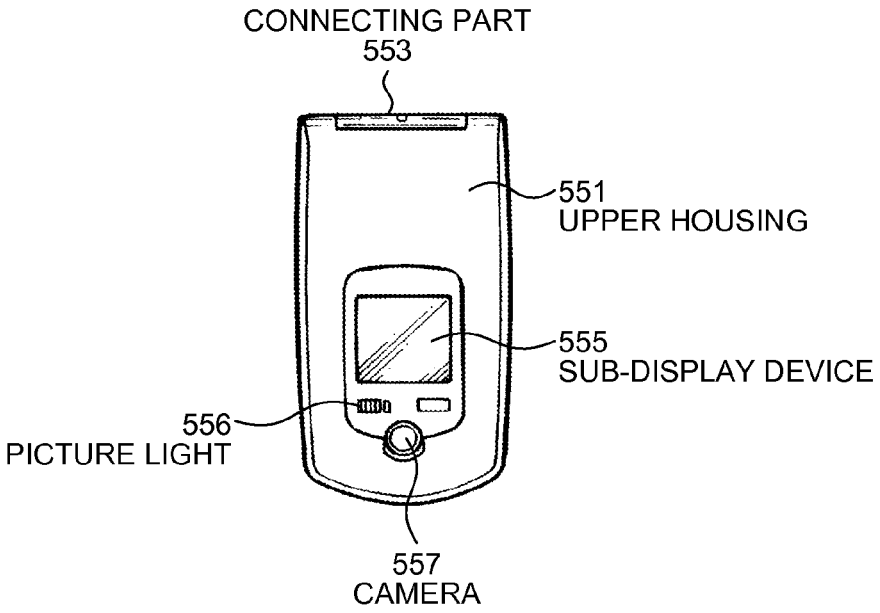
FIG. 22 is a diagram illustrating an example of the electronic apparatus to which the display device according to the embodiment is applied.

The electronic apparatus illustrated in FIGS. 21 and 22 is a mobile phone to which the display device 100 is applied. FIG. 21 is a front view of the mobile phone in an opened state. FIG. 22 is a front view of the mobile phone in a folded state. The mobile phone is configured by connecting an upper housing 551 to a lower housing 552 with a connecting part (hinge part) 553, for example, and includes a display device 554, a sub-display device 555, a picture light 556, and a camera 557. The display device 100 is mounted as the display device 554. The display device 554 of the mobile phone may have a function of detecting a touch operation in addition to a function of displaying an image.

Application Example 6

Figure 23:
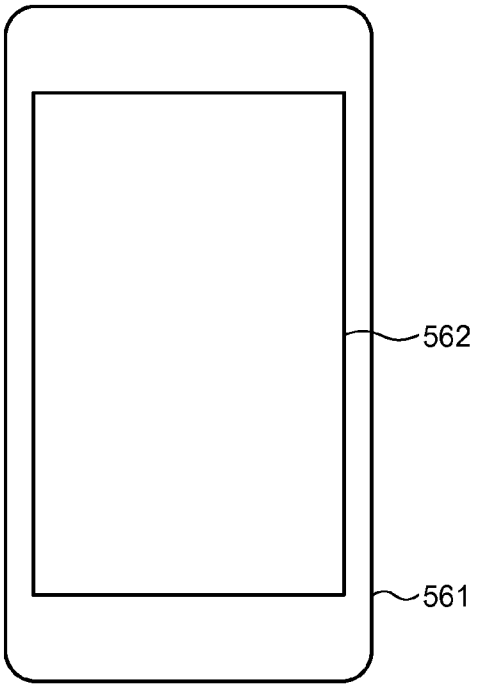
FIG. 23 is a diagram illustrating an example of an electronic apparatus to which the display device according to the embodiment is applied.

The electronic apparatus illustrated in FIG. 23 is a portable information terminal that operates as a portable computer, a multifunctional mobile phone, a mobile computer capable of making a voice call, or a mobile computer capable of performing communications, which may be called a smartphone or a tablet terminal in some cases. The portable information terminal includes a display unit 562 on a surface of a housing 561, for example. The display unit 562 is the display device 100 according to the embodiment.

Application Example 7

Figure 24:
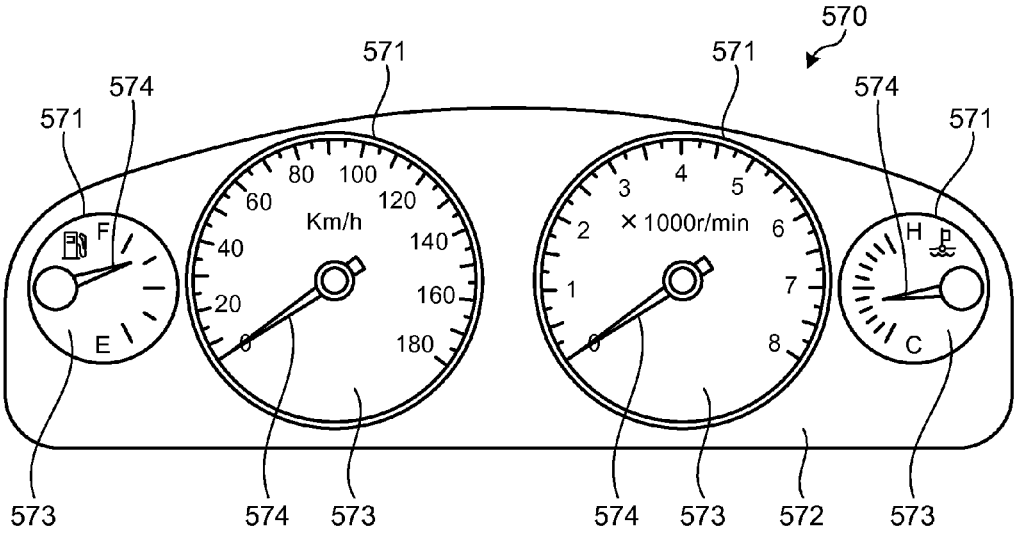
FIG. 24 is a diagram illustrating an example of an electronic apparatus to which the display device according to the embodiment is applied.

FIG. 24 is a schematic configuration diagram of a meter unit according to the embodiment. The electronic apparatus illustrated in FIG. 24 is a meter unit mounted on a vehicle. A meter unit (electronic apparatus) 570 illustrated in FIG. 24 includes a plurality of display devices 100 according to the embodiment such as a fuel gauge, a water-temperature gauge, a speedometer, and a tachometer as display devices 571. All of the display devices 571 are covered with one exterior panel 572.

Each of the display devices 571 illustrated in FIG. 24 has a configuration in which a panel 573 serving as a display module and a movement mechanism serving as an analog display module are combined with each other. The movement mechanism includes a motor serving as a driving module and an indicator 574 rotated by the motor. As illustrated in FIG. 24, the display device 571 can display a scale or warning on a display surface of the panel 573, and the indicator 574 of the movement mechanism can rotate on a display surface of the panel 573.

FIG. 24 illustrates a configuration in which a plurality of display devices 571 are arranged on one exterior panel 572. However, the configuration is not limited thereto. One display device 571 may be arranged in a region surrounded by the exterior panel 572, and the fuel gauge, the water-temperature gauge, the speedometer, the tachometer, and the like may be displayed on the display device. The display device 100A may be applied to the above electronic apparatuses in place of the display device 100.

The display device, the electronic apparatus, and the method for displaying an image according to the present disclosure increase a lighting quantity of the fourth sub-pixel while reducing the error in the color to be displayed, so that the power consumption can be suppressed.

The present disclosure has been described above. However, the present disclosure is not limited thereto. The components according to the present disclosure described above include a component that is easily conceivable by those skilled in the art, substantially the same component, and what is called an equivalent. The components described above can also be appropriately combined with each other. In addition, the components can be variously omitted, replaced, and modified without departing from the gist of the present disclosure.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device comprising:

an image display unit provided with a plurality of pixels each including:

a first sub-pixel for displaying a first color component according to a lighting quantity of a self-luminous body provided to the first sub-pixel;

a second sub-pixel for displaying a second color component according to a lighting quantity of a self-luminous body provided to the second sub-pixel;

a third sub-pixel for displaying a third color component according to a lighting quantity of a self-luminous body provided to the third sub-pixel; and a fourth sub-pixel that has higher luminance or higher power efficiency for display than that of the first sub-pixel, the second sub-pixel, and the third sub-pixel, and displays an additional color component different from the first sub-pixel, the second sub-pixel, and the third sub-pixel according to a lighting quantity of a self-luminous body provided to the fourth sub-pixel;

a replacement ratio calculation unit that calculates a replacement ratio with the additional color component, wherein the replacement ratio is associated with a gain value Wa of the additional color component, and the gain value Wa is calculated on a basis of a minimum value Vmin, and the minimum value Vmin is a total of signal values that can be replaced by the additional color component; and a fourth sub-pixel signal processing unit that receives, as an input signal, input color information to be displayed on a certain pixel obtained based on an input video signal, generates an output signal including an output color information obtained by converting the input color information into the first component, the second component, the third component, and the additional color component based on the replacement ratio, and outputs the generated output signal to a drive circuit that controls driving of the image display unit.

2. The display device according to claim 1, wherein the replacement ratio calculation unit calculates the replacement ratio in a range in which an error in displayed color is equal to or smaller than a permissible value calculated based on an error between an additional color displayed by combining the first sub-pixel, the second sub-pixel, and the third sub-pixel and an additional color displayed by the fourth sub-pixel, and a ratio of luminance of components other than the additional color component with respect to luminance of the additional color component of the input signal.

3. The display device according to claim 1, wherein the replacement ratio calculation unit calculates the replacement ratio so that an error in displayed color in a threshold range calculated based on an error between an additional color displayed by combining the first sub-pixel, the second sub-pixel, and the third sub-pixel and an additional color displayed by the fourth sub-pixel, and a ratio of luminance of components other than the additional color component with respect to luminance of the additional color component of the input signal are.

4. The display device according to claim 1, wherein the replacement ratio calculation unit calculates the replacement ratio based on at least one of luminance, brightness, saturation, and a hue of the input color information.

5. The display device according to claim 4, wherein the error between the additional color displayed by combining the first sub-pixel, the second sub-pixel, and the third sub-pixel and the additional color displayed by the fourth sub-pixel is reduced as luminance of the additional color to be displayed increases, and the replacement ratio calculation unit increases the replacement ratio as a maximum value of the first color component, the second color component, and the third color component increases, when a minimum value of the first color component, the second color component, and the third color component of the input color information is smaller than a certain value.

6. The display device according to claim 5, wherein the replacement ratio calculation unit causes the replacement ratio to be higher than the certain value when the minimum value of the first color component, the second color component, and the third color component of the input color information is higher than a predetermined value.

7. The display device according to claim 1, wherein the replacement ratio calculation unit performs arithmetic processing on a signal value based on the input color information to calculate the replacement ratio.

8. The display device according to claim 1, wherein the input signal is a signal generated by correcting the input video signal.

9. The display device according to claim 1, wherein the fourth sub-pixel signal processing unit calculates a converted input signal including converted color information obtained by converting the input color information into the first component, the second component, the third component, and the additional color component, and the replacement ratio calculation unit calculates the replacement ratio based on the additional color component of the converted input signal.

10. An electronic apparatus comprising the display device according to claim 1.

11. A method for displaying an image of an input signal supplied to a drive circuit in an image display unit provided with a plurality of pixels each including:

a first sub-pixel for displaying a first color component according to a lighting quantity of a self-luminous body provided to the first sub-pixel;

a second sub-pixel for displaying a second color component according to a lighting quantity of a self-luminous body provided to the second sub-pixel;

a third sub-pixel for displaying a third color component according to a lighting quantity of a self-luminous body provided to the third sub-pixel; and a fourth sub-pixel that has higher luminance or higher power efficiency for display than that of the first sub-pixel, the second sub-pixel, and the third sub-pixel, and displays an additional color component different from the first sub-pixel, the second sub-pixel, and the third sub-pixel according to a lighting quantity of a self-luminous body provided to the fourth sub-pixel, the method comprising:

calculating a replacement ratio with the additional color component, wherein the replacement ratio is associated with a gain value Wa of the additional color component, and the gain value Wa is calculated on a basis of a minimum value Vmin, and the minimum value Vmin is a total of signal values that can be replaced by the additional color component; and a fourth sub-pixel signal processing for receiving, as a first input signal, input color information to be displayed on a certain pixel obtained based on an input video signal; generating an output signal including an output color information obtained by converting the input color information into the first color component, the second color component, the third color component, and the additional color component based on the replacement ratio; and outputting the generated output signal to the drive circuit that controls driving of the image display unit.

12. The display device according to claim 1, wherein the gain value Wa is equal to or larger than an offset value when the minimum value Vmin is from 0 to a first predetermined value.

13. The display device according to claim 12, wherein the gain value Wa is larger than the offset value when the minimum value Vmin is between the first predetermined value and the second predetermined value, and wherein the second predetermined value is larger than the first predetermined value.

14. The display device according to claim 13, wherein the gain value Wa has a constant value when the minimum value Vmin is larger than the second predetermined value.

15. The display device according to claim 1, wherein the replacement ratio is further associated with an adjustment term Wb, and the adjustment term Wb is larger than the gain value Wa in a region where the gain value Wa is low.

* * * * *